US007455588B2

(12) United States Patent
Webb et al.

(10) Patent No.: US 7,455,588 B2
(45) Date of Patent: Nov. 25, 2008

(54) GAMING DEVICE HAVING COMPETING POSITIVE AND NEGATIVE OUTCOME EVENTS

(75) Inventors: Bayard S. Webb, Sparks, NV (US); Anthony J. Baerlocher, Reno, NV (US); Michael MacVittie, Reno, NV (US); John G. Gilliland, Reno, NV (US)

(73) Assignee: IGT, Reno, NV (US)

( * ) Notice: Subject to any disclaimer, the term of this patent is extended or adjusted under 35 U.S.C. 154(b) by 745 days.

(21) Appl. No.: 10/651,685

(22) Filed: Aug. 28, 2003

(65) Prior Publication Data

US 2005/0049039 A1 Mar. 3, 2005

(51) Int. Cl.
*A63F 9/24* (2006.01)

(52) U.S. Cl. ..... 463/20; 463/16

(58) Field of Classification Search ..... 463/16, 463/20

See application file for complete search history.

(56) References Cited

U.S. PATENT DOCUMENTS

| | | | |
|---|---|---|---|
| 4,182,515 | A | 1/1980 | Nemeth |
| 4,621,814 | A | 11/1986 | Stepan et al. |
| 4,624,459 | A | 11/1986 | Kaufman |
| 4,695,053 | A | 9/1987 | Vazquez, Jr. et al. |
| 4,838,552 | A | 6/1989 | Hagiwara |
| 4,991,848 | A | 2/1991 | Greenwood et al. |
| 5,152,529 | A | 10/1992 | Okada |
| 5,209,479 | A | 5/1993 | Nagao et al. |
| 5,342,047 | A | 8/1994 | Heidel et al. |
| 5,364,100 | A | 11/1994 | Ludlow et al. |
| 5,393,057 | A | 2/1995 | Marnell, II |
| 5,407,200 | A | 4/1995 | Zalabak |
| 5,423,539 | A | 6/1995 | Nagao |
| 5,449,173 | A | 9/1995 | Thomas et al. |
| 5,456,465 | A | 10/1995 | Durham |
| 5,560,603 | A | 10/1996 | Seelig et al. |
| 5,584,763 | A | 12/1996 | Kelly et al. |
| 5,611,535 | A | 3/1997 | Tiberio |
| 5,647,798 | A | 7/1997 | Falciglia |

(Continued)

FOREIGN PATENT DOCUMENTS

AU 199716432 B2 9/1997

(Continued)

OTHER PUBLICATIONS

American Thunder Screen Shots written by IGT, published in 1998.

(Continued)

*Primary Examiner*—Robert E Pezzuto
*Assistant Examiner*—Jasson H Yoo
(74) *Attorney, Agent, or Firm*—Bell, Boyd & Lloyd

(57) ABSTRACT

A gaming device including an outcome or award event which is triggered from a base game when at least one positive modifier symbol and at least one award symbol are indicated on the reels. In the bonus game, the positive modifier symbol includes at least one positive modifier which increases a bonus award associated with the award symbol. A negative modifier symbol, if indicated on the reels, includes at least one negative modifier which reduces the bonus award associated with the award symbol. The positive modifiers and negative modifiers are applied to the award to provide a modified award to the player in the game.

35 Claims, 16 Drawing Sheets

U.S. PATENT DOCUMENTS

| | | | | |
|---|---|---|---|---|
| 5,722,891 | A | 3/1998 | Inoue | |
| 5,732,948 | A | 3/1998 | Yoseloff | |
| 5,772,506 | A | 6/1998 | Marks et al. | |
| 5,775,692 | A | 7/1998 | Watts et al. | |
| 5,779,544 | A | 7/1998 | Seelig et al. | |
| 5,816,918 | A * | 10/1998 | Kelly et al. | 463/16 |
| 5,823,874 | A | 10/1998 | Adams | |
| 5,833,537 | A | 11/1998 | Barrie | |
| 5,848,932 | A | 12/1998 | Adams | |
| 5,855,514 | A | 1/1999 | Kamille | |
| 5,882,261 | A | 3/1999 | Adams | |
| 5,918,880 | A | 7/1999 | Voigt, IV et al. | |
| 5,919,088 | A | 7/1999 | Weiss | |
| 5,934,672 | A | 8/1999 | Sines et al. | |
| 5,935,002 | A | 8/1999 | Falciglia | |
| 5,947,820 | A | 9/1999 | Morro et al. | |
| 5,964,463 | A | 10/1999 | Moore, Jr. | |
| 5,971,849 | A | 10/1999 | Falciglia | |
| 5,976,015 | A | 11/1999 | Seelig et al. | |
| 5,980,384 | A | 11/1999 | Barrie | |
| 5,988,638 | A | 11/1999 | Rodesch et al. | |
| 5,997,400 | A | 12/1999 | Seelig et al. | |
| 5,997,401 | A | 12/1999 | Crawford | |
| 6,003,867 | A | 12/1999 | Rodesch et al. | |
| 6,004,207 | A | 12/1999 | Wilson, Jr. et al. | |
| 6,012,982 | A | 1/2000 | Piechowiak et al. | |
| 6,015,346 | A | 1/2000 | Bennett | |
| 6,019,369 | A | 2/2000 | Nakagawa et al. | |
| 6,033,307 | A * | 3/2000 | Vancura | 463/20 |
| 6,059,289 | A | 5/2000 | Vancura | |
| 6,089,976 | A | 7/2000 | Schneider et al. | |
| 6,089,977 | A | 7/2000 | Bennett | |
| 6,089,978 | A | 7/2000 | Adams | |
| 6,102,400 | A | 8/2000 | Scott et al. | |
| 6,102,798 | A | 8/2000 | Bennett | |
| 6,117,009 | A | 9/2000 | Yoseloff | |
| 6,120,031 | A | 9/2000 | Adams | |
| 6,126,542 | A | 10/2000 | Fier | |
| 6,135,885 | A | 10/2000 | Lermusiaux | |
| 6,142,873 | A | 11/2000 | Weiss et al. | |
| 6,149,521 | A | 11/2000 | Sanduski | |
| 6,159,097 | A | 12/2000 | Gura | |
| 6,159,098 | A | 12/2000 | Slomiany et al. | |
| 6,173,955 | B1 | 1/2001 | Perrie et al. | |
| 6,174,233 | B1 | 1/2001 | Sunaga et al. | |
| 6,174,235 | B1 | 1/2001 | Walker et al. | |
| 6,186,894 | B1 | 2/2001 | Mayeroff | |
| 6,190,254 | B1 | 2/2001 | Bennett | |
| 6,190,255 | B1 | 2/2001 | Thomas et al. | |
| 6,203,429 | B1 | 3/2001 | Demar et al. | |
| 6,220,959 | B1 | 4/2001 | Holmes, Jr. et al. | |
| 6,224,482 | B1 | 5/2001 | Bennett | |
| 6,224,483 | B1 | 5/2001 | Mayeroff | |
| 6,231,442 | B1 | 5/2001 | Mayeroff | |
| 6,234,897 | B1 | 5/2001 | Frohm et al. | |
| 6,238,288 | B1 | 5/2001 | Walker et al. | |
| 6,251,013 | B1 | 6/2001 | Bennett | |
| 6,261,177 | B1 | 7/2001 | Bennett | |
| 6,270,409 | B1 | 8/2001 | Shuster | |
| 6,270,411 | B1 | 8/2001 | Gura et al. | |
| 6,302,790 | B1 | 10/2001 | Brossard | |
| 6,305,686 | B1 | 10/2001 | Perrie et al. | |
| 6,309,299 | B1 | 10/2001 | Weiss | |
| 6,309,300 | B1 | 10/2001 | Glavich | |
| 6,311,976 | B1 | 11/2001 | Yoseloff et al. | |
| 6,312,334 | B1 | 11/2001 | Yoseloff | |
| 6,315,660 | B1 | 11/2001 | DeMar et al. | |
| 6,315,663 | B1 | 11/2001 | Sakamoto | |
| 6,315,664 | B1 | 11/2001 | Baerlocher et al. | |
| 6,319,124 | B1 | 11/2001 | Baerlocher et al. | |
| 6,322,309 | B1 | 11/2001 | Thomas et al. | |
| 6,328,649 | B1 | 12/2001 | Randall et al. | |
| 6,334,613 | B1 | 1/2002 | Yoseloff | |
| 6,334,814 | B1 | 1/2002 | Adams | |
| 6,336,863 | B1 | 1/2002 | Baerlocher et al. | |
| 6,340,158 | B2 | 1/2002 | Preice et al. | |
| 6,346,043 | B1 | 2/2002 | Colin et al. | |
| 6,347,996 | B1 | 2/2002 | Gilmore et al. | |
| 6,364,767 | B1 | 4/2002 | Brossard et al. | |
| 6,364,768 | B1 | 4/2002 | Acres et al. | |
| 6,375,570 | B1 | 4/2002 | Poole | |
| 6,394,902 | B1 | 5/2002 | Glavich et al. | |
| 6,398,218 | B1 | 6/2002 | Vancura | |
| 6,406,369 | B1 | 6/2002 | Baerlocher et al. | |
| 6,413,161 | B1 | 7/2002 | Baerlocher et al. | |
| 6,413,162 | B1 | 7/2002 | Baerlocher et al. | |
| 6,416,408 | B2 | 7/2002 | Tracy et al. | |
| 6,419,579 | B1 | 7/2002 | Bennett | |
| 6,425,824 | B1 | 7/2002 | Baerlocher et al. | |
| 6,439,993 | B1 | 8/2002 | O'Halloran | |
| 6,443,452 | B1 | 9/2002 | Brune | |
| 6,454,651 | B1 | 9/2002 | Yoseloff | |
| 6,471,208 | B2 | 10/2002 | Yoseloff et al. | |
| 6,481,713 | B2 | 11/2002 | Perrie et al. | |
| 6,491,584 | B2 | 12/2002 | Graham et al. | |
| 6,494,454 | B2 | 12/2002 | Adams | |
| 6,514,141 | B1 | 2/2003 | Kaminkow et al. | |
| 6,537,150 | B1 | 3/2003 | Luciano et al. | |
| 6,537,152 | B2 | 3/2003 | Seelig et al. | |
| 6,558,253 | B1 | 5/2003 | DeSimone et al. | |
| 6,561,900 | B1 | 5/2003 | Baerlocher et al. | |
| 6,561,904 | B2 | 5/2003 | Locke et al. | |
| 6,565,433 | B1 | 5/2003 | Baerlocher et al. | |
| 6,565,436 | B1 | 5/2003 | Baerlocher | |
| 6,569,016 | B1 | 5/2003 | Baerlocher | |
| 6,582,306 | B1 | 6/2003 | Kaminkow | |
| 6,602,137 | B2 | 8/2003 | Kaminkow et al. | |
| 6,604,740 | B1 | 8/2003 | Singer et al. | |
| 6,609,971 | B2 | 8/2003 | Vancura | |
| 6,609,972 | B2 | 8/2003 | Seelig et al. | |
| 6,631,141 | B1 | 10/2003 | Kumar et al. | |
| 6,632,139 | B1 | 10/2003 | Baerlocher | |
| 6,634,945 | B2 | 10/2003 | Glavich et al. | |
| 6,666,765 | B2 | 12/2003 | Vancura | |
| 6,669,559 | B1 | 12/2003 | Baerlocher et al. | |
| 6,688,975 | B2 | 2/2004 | Baerlocher et al. | |
| 6,692,355 | B2 | 2/2004 | Baerlocher et al. | |
| 6,712,694 | B1 | 3/2004 | Nordman | |
| 6,719,630 | B1 | 4/2004 | Seelig et al. | |
| 6,722,983 | B2 | 4/2004 | Kaminkow et al. | |
| 6,726,565 | B2 | 4/2004 | Hughs-Baird | |
| 6,733,389 | B2 | 5/2004 | Webb et al. | |
| 6,758,747 | B2 | 7/2004 | Baerlocher | |
| 6,776,717 | B2 | 8/2004 | Shinohara et al. | |
| 6,786,820 | B2 | 9/2004 | Gerrard et al. | |
| 6,796,899 | B2 | 9/2004 | Baerlocher | |
| 6,796,900 | B2 | 9/2004 | Baerlocher et al. | |
| 6,805,349 | B2 | 10/2004 | Baerlocher et al. | |
| 6,869,360 | B2 | 3/2005 | Marks et al. | |
| 6,905,406 | B2 | 6/2005 | Kaminkow et al. | |
| 6,913,532 | B2 | 7/2005 | Baerlocher et al. | |
| 6,921,335 | B2 | 7/2005 | Rodgers et al. | |
| 6,955,600 | B2 | 10/2005 | Glavich et al. | |
| 6,981,635 | B1 | 1/2006 | Hughs-Baird et al. | |
| 6,988,947 | B2 | 1/2006 | Baerlocher et al. | |
| 6,997,806 | B2 | 2/2006 | Falciglia, Sr. | |
| 7,169,042 | B2 | 1/2007 | Muir et al. | |
| 2001/0009865 | A1 | 7/2001 | Demar et al. | |
| 2002/0010017 | A1 | 1/2002 | Bennett | |
| 2003/0013519 | A1 | 1/2003 | Bennett | |
| 2003/0045350 | A1 | 3/2003 | Baerlocher et al. | |
| 2003/0054875 | A1 | 3/2003 | Marks et al. | |
| 2003/0060272 | A1 | 3/2003 | Glavich et al. | |
| 2003/0073483 | A1 | 4/2003 | Glavich et al. | |

| | | | |
|---|---|---|---|
| 2003/0162585 | A1 | 8/2003 | Bigelow et al. |
| 2003/0203753 | A1 | 10/2003 | Muir et al. |
| 2003/0211879 | A1 | 11/2003 | Englman |
| 2003/0224857 | A1 | 12/2003 | Baerlocher |
| 2004/0002372 | A1 | 1/2004 | Rodgers et al. |
| 2004/0038731 | A1 | 2/2004 | Englman |
| 2004/0053666 | A1 | 3/2004 | Vancura |
| 2004/0053669 | A1 | 3/2004 | Gerrard et al. |
| 2004/0053672 | A1 | 3/2004 | Baerlocher |
| 2004/0072612 | A1 | 4/2004 | Rodgers et al. |
| 2004/0137982 | A1 | 7/2004 | Cuddy et al. |
| 2004/0147306 | A1 | 7/2004 | Randall et al. |
| 2005/0049035 | A1 | 3/2005 | Baerlocher et al. |
| 2005/0054875 | A1 | 3/2005 | Hei |
| 2005/0070354 | A1 | 3/2005 | Baerlocher et al. |
| 2005/0233801 | A1 | 10/2005 | Baerlocher |
| 2005/0266917 | A1 | 12/2005 | Glavich |
| 2006/0035699 | A1 | 2/2006 | Falciglia, Sr. |

FOREIGN PATENT DOCUMENTS

| | | | |
|---|---|---|---|
| AU | A-50327/96 | | 10/1997 |
| AU | 199748484 | | 7/1998 |
| AU | A-63553/98 | | 10/1998 |
| EP | 0688002 | A1 | 12/1995 |
| EP | 0 798 676 | A1 | 10/1997 |
| EP | 0 874 337 | A1 | 10/1998 |
| EP | 0874337 | A1 | 10/1998 |
| EP | 0 944 030 | A2 | 3/1999 |
| EP | 0926645 | A2 | 6/1999 |
| EP | 0944030 | A2 | 9/1999 |
| EP | 0945837 | A2 | 9/1999 |
| EP | 0 981 119 | A2 | 2/2000 |
| EP | 0 984 409 | A2 | 3/2000 |
| GB | 2161008 | A | 1/1986 |
| GB | 2 322 217 | A | 8/1998 |
| GB | 2 328 311 | A | 2/1999 |
| GB | 2 406 697 | | 3/2004 |
| WO | WO 0012186 | | 3/2000 |
| WO | WO 00/32286 | | 6/2000 |
| WO | WO 01/26019 | A1 | 4/2001 |
| WO | WO 03/075235 | | 9/2003 |
| WO | WO 2004/025584 | A2 | 3/2004 |

OTHER PUBLICATIONS

Bonus Times written by Bally Gaming , published in Jul. 2000.
Jazzy Jackpots Article written by Strictly Slots, published Mar. 2001.
Little Green Men, Jr. Article written by Strictly Slots, published in 2003.
Neon Nights Advertisement written by IGT, published in 2000.
Polly & Roger Brochure written by VLC, Inc., published in 2000.
Slot Machines A Pictorial History of the First 100 Years, 5th edition [In Part], written by Marshall Fey, published 1983 to 1997, on or before December thereof.
Texas Teas Advertisement written by IGT, published in 2000.
Top Cat Brochure written by WMS Gaming, Inc. , published date not known.
Top Dollar Brochure written by IGT, published in 1998.
Treasure Tunnel, Treasure Wheel Brochure, written by Sigma Game, Inc., published prior to 2001.
Wheel of Fortune Advertisement written Barcrest, published in 1995.
Wheel of Fortune Video Advertisement written by IGT, published in 1999.
X Factor Brochure written by WMS Gaming, Inc., published in 1998.
Bally Slot Machines Electro-Mechanicals 1964-1980 Book [In Part], Revised 3rd Edition written by Marshall Fey.
Catch A Wave Advertisement written by IGT, published in Dec. 2000.
Dolphin Treasure Advertisement written by Aristocrat Leisure Industries Pty., Ltd., published in 1996.
Field Testing New Slots Article, written by Strictly Slots, published in Jul. 2000.
Good Times Advertisement written by International Game Technology, published in 1999.
Jackpot Devil Gaming Device Paytable, written by IGT, published prior to Aug. 2003.
Leopard Spots™ (website) written by www.igt.com, printed Mar. 21, 2001.
Mega Multiplier® (website) written by www.wmsgaming.com, printed May 22, 2001.
Spin Til you Win Game Description written by IGT, published in 1996.
Super Cherry Advertisement written by International Game Technology, published in 2001.
Take Your Pick Article, Strictly Slots, published Mar. 2001.
Yahtzee Video Game Advertisement, written by Mikohn Winning Solutions Worldwide, published 1999.

* cited by examiner

GAMING DEVICE HAVING COMPETING POSITIVE AND NEGATIVE OUTCOME EVENTS

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

Many existing gaming machines, such as traditional slot machines, include bonus games. Typically, a bonus game begins when the player reaches a bonus triggering event in the primary game of the gaming device. In slot machines with reels, the triggering event usually occurs when the player reaches a predetermined combination of symbols on the reels. Usually the bonus scheme provides the player with an opportunity to gain bonus value before the bonus round terminates.

In existing bonus schemes with symbol generators such as reels, the bonus game terminates after the player receives a predetermined number of opportunities to gain a bonus award or after the player accumulates a predetermined bonus award amount. The gaming device then returns the player to the primary game.

To increase player enjoyment and excitement, it is desirable to provide players with new games for gaming devices.

SUMMARY OF THE INVENTION

The present invention relates generally to a reel game and specifically to a bonus game which includes a bonus outcome determined by or modified by competing positive and negative outcome events.

In one embodiment, the bonus game is triggered when at least one positive modifier symbol and at least one award symbol are indicated on designated or specific reels in the base or primary game. In another embodiment, the bonus game is triggered when at least one positive modifier symbol, at least one award symbol, and at least one negative modifier symbol are generated or indicated on the reels.

In one embodiment, once the bonus game is initiated, the award symbol or symbols indicated on the reels reveal a bonus outcome such as a bonus award to the player. The bonus outcome or bonus award may be randomly determined, predetermined or determined based on a wager made by the player in the game. The bonus outcome or bonus award displayed to the player is modified by the positive and negative modifier symbols as described below. Therefore, the gaming device in the present invention provides increased excitement and enjoyment for a player because the player does not know what the final bonus award or bonus outcome will be until the game ends.

In one embodiment, the positive and negative modifier symbols each generate at least one positive and negative modifier which modify the bonus award associated with the award symbol. In another embodiment, a plurality of positive and negative modifiers are generated by each of the positive and negative modifier symbols indicated on the reels and modify the bonus award associated with the award symbol. In a further embodiment, the negative modifier symbol generates at least one negative modifier which modifies the bonus award before any of the positive modifier symbols generate positive modifiers to modify the bonus award. It should be appreciated that the positive and negative modifiers may be generated and modify the bonus award in any suitable order or sequence desired by the game implementer.

In one embodiment, the negative modifier symbol generates negative modifiers that modify the bonus award in the bonus game. The negative modifiers may be negative values, negative percentages or any suitable negative value or modifier which reduces the bonus outcome or bonus award associated with the award symbol. In one embodiment, one or more negative modifier symbols are indicated on the reels. Each of the negative modifier symbols generates one or more negative modifiers that modify the bonus award associated with the award symbol. The negative modifiers may be randomly determined, predetermined, determined based on a wager made by the player or determined according to any suitable determination method.

Once all of the negative modifiers modify the bonus award associated with the award symbol, the positive modifier symbol or symbols on the reels each generate at least one positive modifier which modifies the bonus outcome or bonus award associated with the award symbol. The positive modifiers may be positive values, positive multipliers, positive percentages or any suitable positive modifier. The positive modifiers are generated and modify the bonus outcome or bonus award to increase the bonus outcome or bonus award in the bonus game. Once all of the positive modifiers modify the bonus outcome or bonus award, the game ends and the final modified bonus award is provided to the player in the bonus game.

In another embodiment, the reels include a plurality of positive modifier symbols and a plurality of negative modifier symbols. In this embodiment, the gaming device causes all of the positive modifier symbols to generate at least one positive modifier and apply the positive modifiers to the bonus award or outcome. The gaming device then causes the negative modifier symbols to each generate and apply at least one negative modifier to the bonus award. In a further embodiment, all of the negative modifiers generated by the negative modifier symbols are applied to the bonus award first, and then all of the positive modifiers are generated and applied to the bonus award. In another embodiment, the positive and negative modifiers are alternately generated and applied to the bonus award. The positive and negative modifiers may be generated and applied in any suitable order or sequence.

In a further embodiment, the reels include a plurality of award symbols and at least one positive modifier symbol and at least one negative modifier symbol. In one embodiment, all of the positive modifiers are generated and applied to each of the bonus awards associated with each of the award symbols before the negative modifiers are generated and applied to the bonus awards. In another embodiment, all of the negative modifiers are generated and applied to each of the bonus awards before the positive modifiers are generated and applied to the bonus awards. In a further embodiment, all of the positive and negative modifier symbols alternately generate and apply positive and negative modifiers to each of the bonus awards. It should be appreciated that the positive and negative modifiers may be generated and applied to each of the bonus awards in any suitable order or sequence.

In a further embodiment, a designated number of positive modifiers are associated with each of the positive modifier symbols occurring on the reels and a designated number of negative modifiers are associated with each of the negative modifier symbols occurring on the reels. The designated number of positive and negative modifiers associated with each of the positive and negative modifier symbols may be randomly determined, pre-determined or determined according to any suitable determination method. Additionally, the values or amounts of each of the positive and negative modifiers may be randomly determined, pre-determined or determined according to any suitable determination method.

In one embodiment, a probability of being selected or determined is associated with each of the positive and negative modifiers generated by the positive and negative modifier symbols. The gaming device selects each of the positive and negative modifiers generated by the positive and negative modifier symbols based on the probabilities. In one embodiment, the positive modifiers include one relatively large positive modifier and a plurality of relatively small positive modifiers. In this embodiment, the probabilities associated with the relatively large positive modifier is less than the probabilities associated with at least one of the relatively small positive modifiers. Similarly, the negative modifiers include one relatively large negative modifier and a plurality of relatively small negative modifiers. In this embodiment, the probability associated with the relatively large negative modifier is less than at least one of the probabilities associated with the relatively small negative modifiers. Any suitable probability or probabilities may be associated with the positive and negative modifiers in the game.

It is therefore an advantage of the present invention to provide a gaming device including at least one positive modifier and at least one negative modifier which modify an award provided to a player.

Another advantage of the present invention is to provide a gaming device including a plurality of positive modifiers, a plurality of negative modifiers and at least one award where the each of the positive modifiers and each of the negative modifiers modify each of the awards.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE DRAWINGS

FIGS. 4A, 4B, 4C, 4D, 4E, 4F, 4G, 4H, 41 and 4J are enlarged front elevation views of one of the display devices of FIGS. 1A and 1B illustrating an example of the embodiment of FIG. 3 where one positive modifier symbol, one award symbol and one negative modifier symbol are indicated on the reels.

DETAILED DESCRIPTION OF THE INVENTION

Figure 1A:
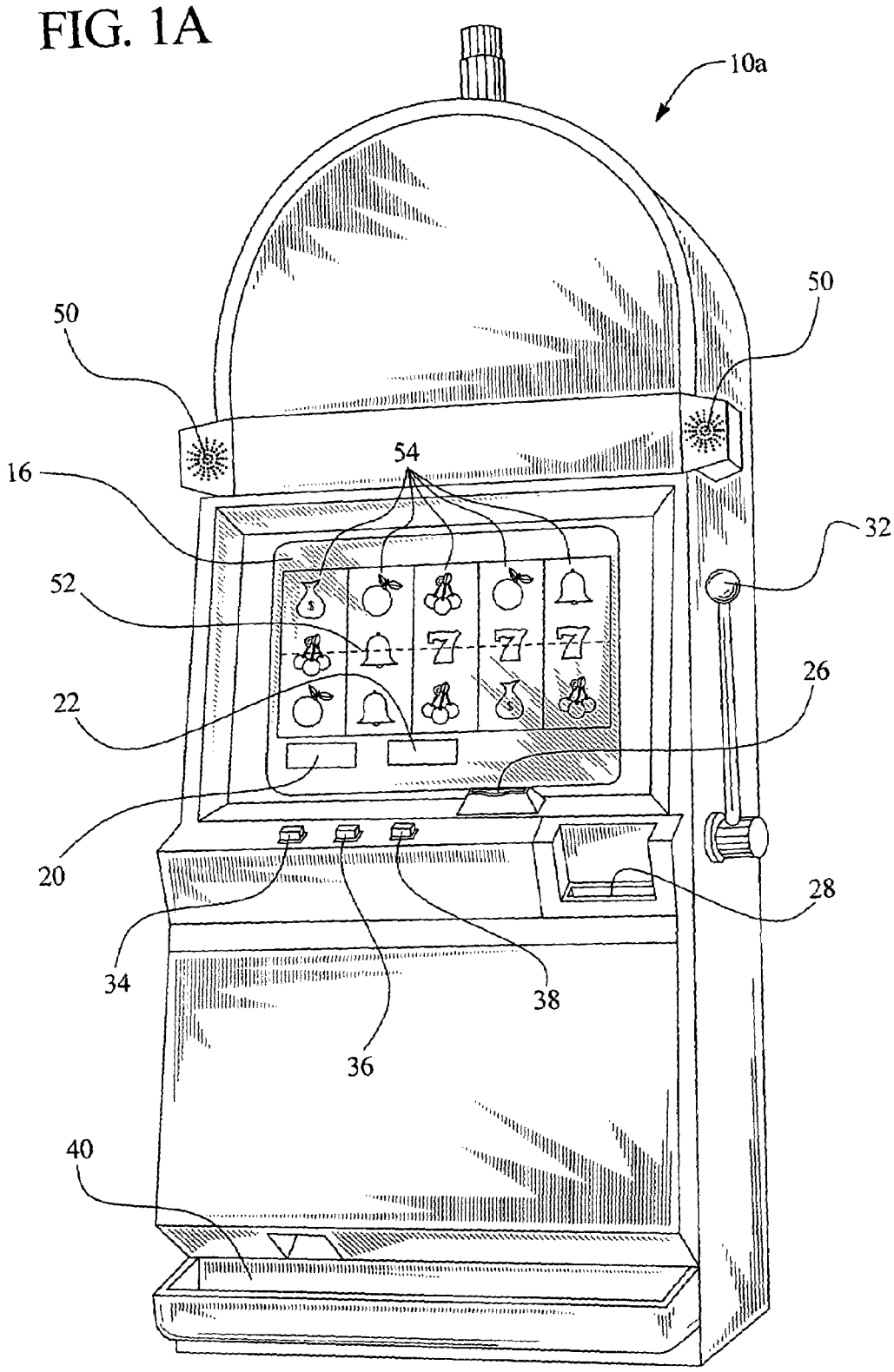
FIG. 1A is a front perspective view of one embodiment of the gaming device of the present invention.
Figure 1B:
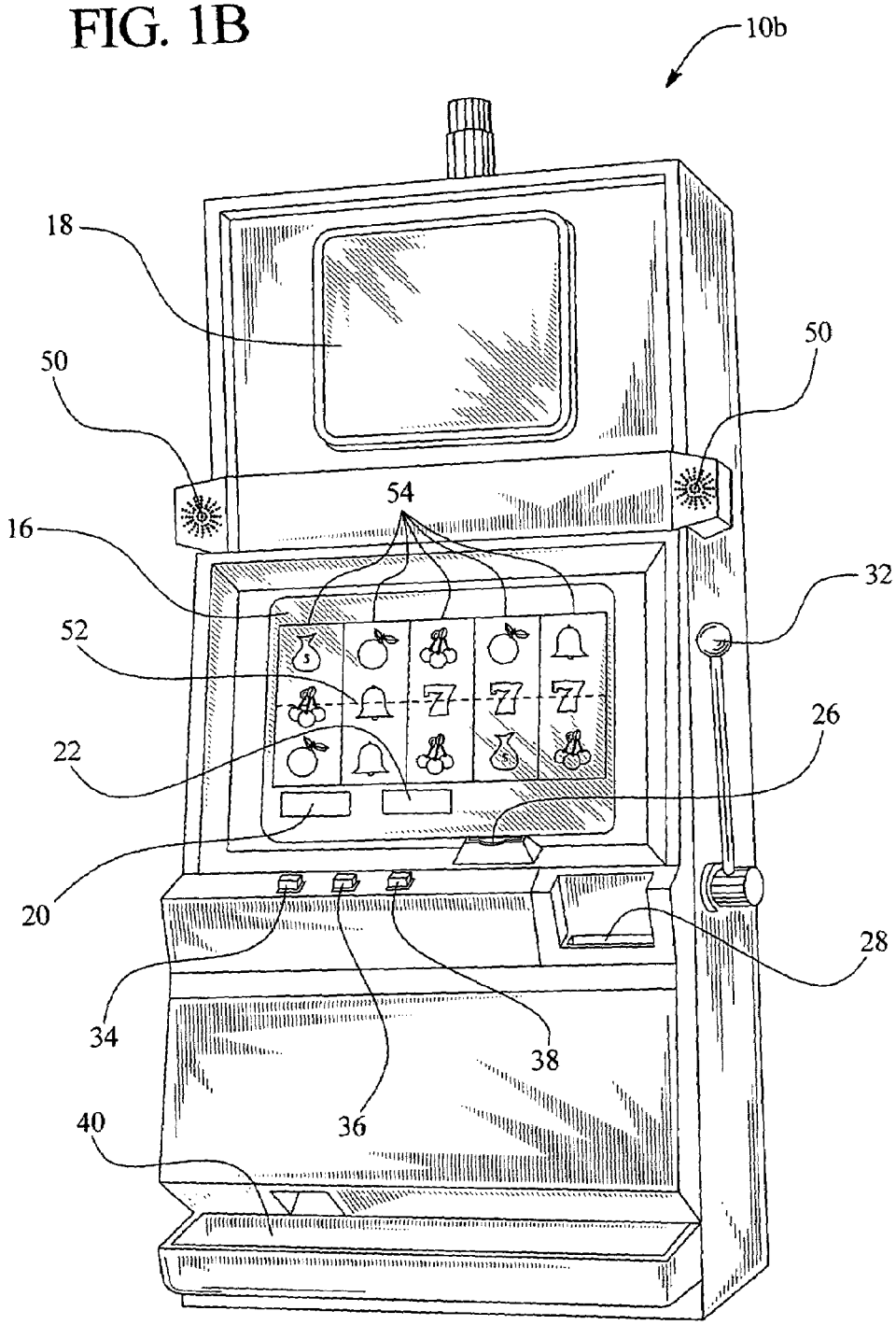
FIG. 1B is a front perspective view of another embodiment of the gaming device of the present invention.

Referring now to the drawings, two alternative embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10.

In one embodiment, as illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device can be constructed with varying cabinet and display configurations.

Figure 2A:
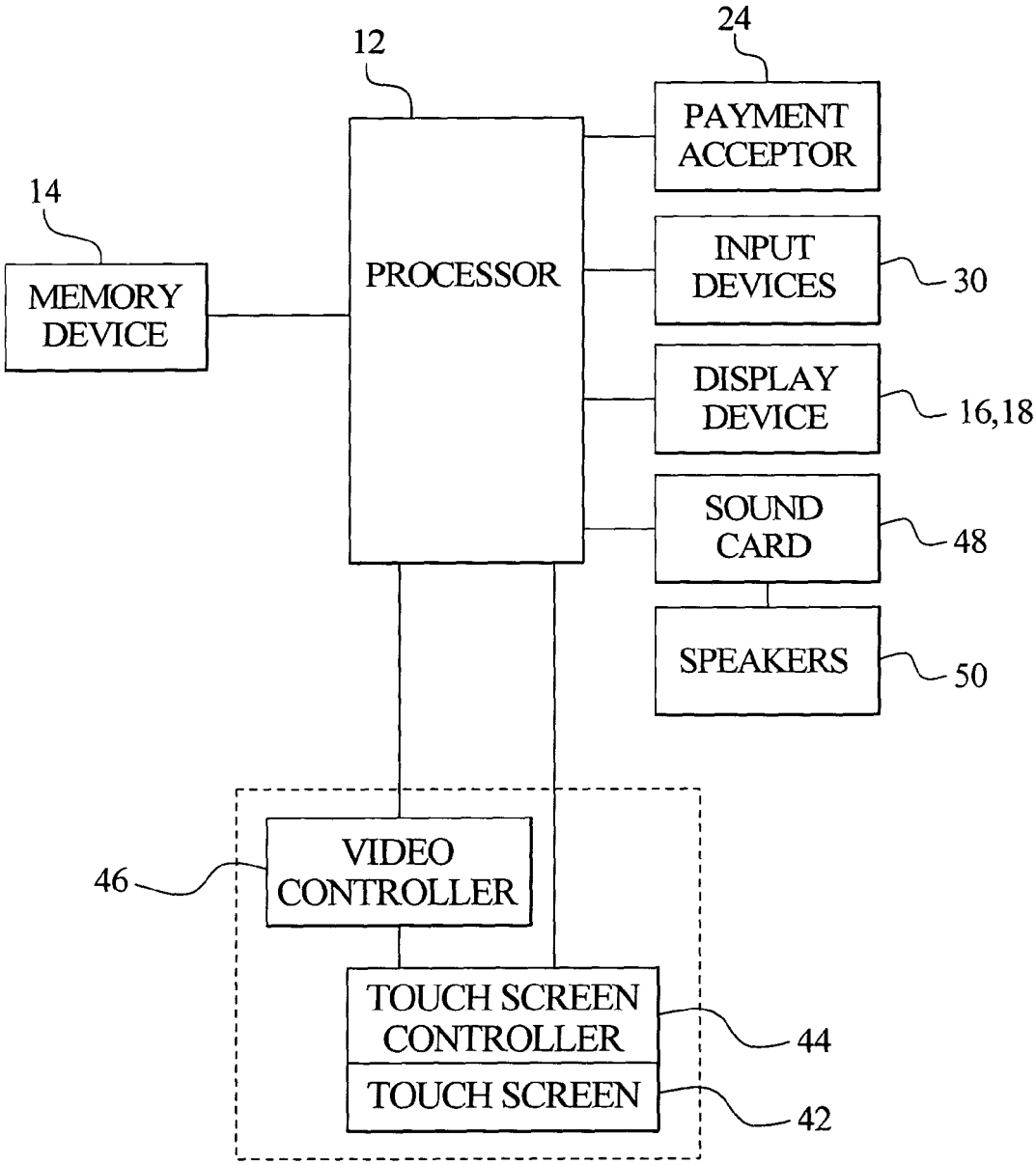
FIG. 2A is a schematic block diagram of the electronic configuration of one embodiment of the gaming device of the present invention.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM). In one embodiment, the memory device includes read only memory (ROM). In one embodiment, the memory device includes flash memory and/or EEPROM (electrically erasable programmable read only memory). Any other suitable magnetic, optical and/or semiconductor memory may be implemented in conjunction with the gaming device of the present invention.

In one embodiment, part or all of the program code and/or operating data described above can be stored in a detachable or removable memory device, including, but not limited to, a suitable cartridge, disk or CD ROM. A player can use such a removable memory device in a desktop, a laptop personal computer, a personal digital assistant (PDA) or other computerized platform. The processor and memory device may be collectively referred to herein as a "computer" or "controller."

In one embodiment, as discussed in more detail below, the gaming device randomly generates awards and/or other game outcomes based on probability data. That is, each award or other game outcome is associated with a probability and the gaming device generates the award or other game outcome to be provided to the player based on the associated probabilities. In this embodiment, since the gaming device generates outcomes randomly or based upon a probability calculation, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device removes the provided award or other game outcome from the predetermined set or pool. Once removed from the set or pool, the specific provided award or other game outcome cannot be provided to the player again. This type of gaming device provides players with all of the available awards or other game outcomes over the course of the play cycle and guarantees the amount of actual wins and losses.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any secondary game associated with the primary game as well as information relating to the primary or secondary game. The alternative embodiment shown in FIG. 1B includes a central display device 16 and an upper display device 18. The upper display device may display the primary game, any suitable secondary game associated with the primary game and/or information relating to the primary or secondary game. As seen in FIGS. 1A and 1B, in one embodiment, gaming device includes a credit display 20 which displays a player's current number of credits, cash, account balance or the equivalent. In one embodiment, gaming device includes a bet display 22 which displays a player's amount wagered.

The display devices may include, without limitation, a monitor, a television display, a plasma display, a liquid crystal display (LCD) a display based on light emitting diodes (LED) or any other suitable electronic device or display mechanism. In one embodiment, as described in more detail below, the display device includes a touch-screen with an associated touch-screen controller. The display devices may be of any suitable configuration, such as a square, rectangle, elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, tournament advertisements and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one and preferably a plurality of game or other suitable images, symbols or indicia.

As illustrated in FIG. 2A, in one embodiment, the gaming device includes at least one payment acceptor 24 in communication with the processor. As seen in FIGS. 1A and 1B, the payment acceptor may include a coin slot 26 and a payment, note or bill acceptor 28, where the player inserts money, coins or tokens. The player can place coins in the coin slot or paper money, ticket or voucher into the payment, note or bill acceptor. In other embodiments, devices such as readers or validators for credit cards, debit cards or credit slips could be used for accepting payment. In one embodiment, a player may insert an identification card into a card reader of the gaming device. In one embodiment, the identification card is a smart card having a programmed microchip or a magnetic strip coded with a player's identification, credit totals and other relevant information. In one embodiment, money may be transferred to a gaming device through electronic funds transfer. When a player funds the gaming device, the processor determines the amount of funds entered and the corresponding amount is shown on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is read by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier or funding to the player's electronically recordable identification card.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching touch-screen at the appropriate places.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a player or other sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and that image can be incorporated into the primary and/or secondary game as a game image, symbol or indicia.

In one embodiment, in addition to winning credits in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game.

In one embodiment, the bonus or secondary game may be any type of suitable game, either similar to or completely different from the base or primary game. In one embodiment, the gaming device includes a program which will automatically begin a bonus round when the player has achieved a triggering event or qualifying condition in the base or primary game. In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In another embodiment, the triggering event or qualifying condition may be by exceeding a certain amount of game play (number of games, number of credits, amount of time), reaching a specified number of points earned during game play or as a random award.

In one embodiment, once a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or geometric increase in the number of bonus wagering credits awarded. In one embodiment, extra bonus wagering credits may be redeemed during the bonus game to extend play of the bonus game.

In one embodiment, no separate entry fee or buy in for a bonus game need be employed. That is, a player may not purchase an entry into a bonus game; he must win or earn entry through play of the primary game and, thus, play of the primary game is encouraged. In another embodiment, qualification of the bonus or secondary game could be accomplished through a simple "buy in" by the player if, for example, the player has been unsuccessful at qualifying through other specified activities.

Figure 2B:
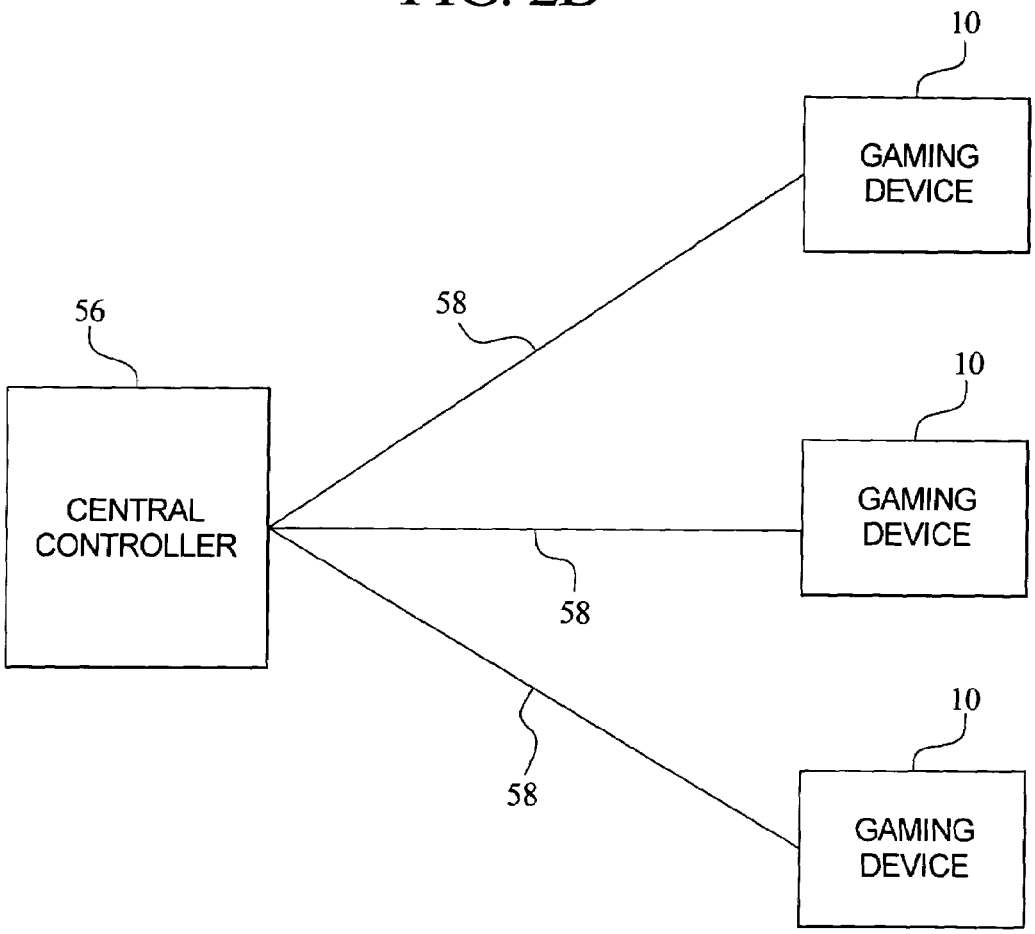
FIG. 2B is a schematic block diagram illustrating a plurality of gaming terminals and communication with a central controller.

In one embodiment, as illustrated in FIG. 2B, one or more of the gaming devices 10 of the present invention may be connected to each other through a data network or a remote communication link 58 with some or all of the functions of each gaming device provided at a central location such as a central server or central controller 56. More specifically, the processor of each gaming device may be designed to facilitate transmission of signals between the individual gaming device and the central server or controller.

In one embodiment, the game outcome provided to the player is determined by a central server or controller and provided to the player at the gaming device of the present invention. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such a free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, one or more of the gaming devices of the present invention are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

A plurality of the gaming devices of the present invention are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system of the present invention may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital signal line (DSL), T-1 line, coaxial cable, fiber optic cable, or other suitable connection. In this embodiment, players may access an Internet game page from any location where an internet connection and computer, or other internet facilitator are available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications according to the present invention, particularly if such communications are encrypted. Higher data transmission speeds may be useful for enhancing the sophistication and response of the display and interaction with the player.

In another embodiment, a plurality of gaming devices at one or more gaming sites may be networked to a central server in a progressive configuration, as known in the art, wherein a portion of each wager to initiate a base or primary game may be allocated to bonus or secondary event awards. In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state.

In one embodiment, the host site computer is maintained for the overall operation and control of the system. In this embodiment, a host site computer oversees the entire progressive gaming system and is the master for computing all progressive jackpots. All participating gaming sites report to, and receive information from, the host site computer. Each central server computer is responsible for all data communication between the gaming device hardware and software and the host site computer.

Positive and Negative Modifier Symbols

The present invention is directed to a gaming device having a game such as a bonus game, including a plurality of reels having positive and negative modifier symbols which modify a bonus award provided to the player in the bonus game.

Figure 3:
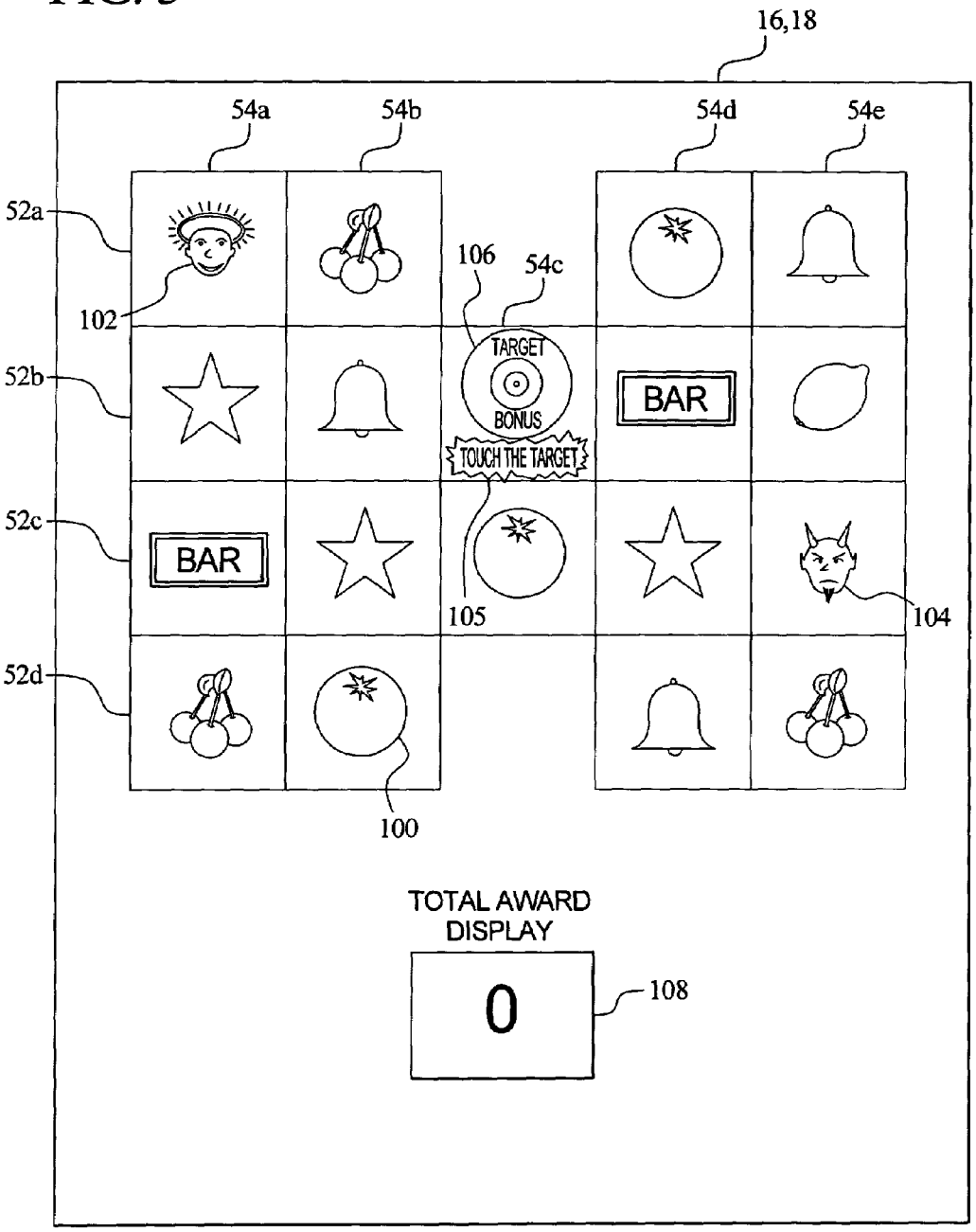
FIG. 3 is an enlarged front elevation view of one of the display devices of FIGS. 1A and 1B illustrating one embodiment of the present invention.

Referring now to FIG. 3, the gaming device includes a plurality of reels such as reels 54*a*, 54*b*, 54*c*, 54*d* and 54*e*. The reels 54 in one embodiment include the independent reels described in U.S. Pat. No. 6,413,162. Specifically, reels or reel columns 54*a*, 54*b*, 54*d* and 54*e* include four independent reels which each display a symbol 100. Additionally, reel 54*c* includes two independent reels which each display a symbol 100. In one embodiment, the plurality of reels 54 include a plurality of symbols 100 such as a star symbol, a bell symbol, an orange symbol, a cherry symbol and a bar symbol. Additionally, at least one of the reels include a positive modifier symbol such as the angel symbol 102, a negative modifier symbol such as the devil symbol 104 and an award symbol such as the target symbol 106. It should be appreciated that the positive modifier symbol, the negative modifier symbol and the award symbol may be any suitable symbol, character, picture or image. In this embodiment, the angel symbol 102 and the devil symbol 104 modify a bonus outcome such as a bonus award displayed by the target symbol 106 as described below.

In one embodiment, the positive modifier symbol or angel symbol 102 is only included on the first reel or 54*a*. Reel 54*a* may include one or more angel symbols 102 in a game. Similarly, the devil symbol 104 is only included on the fifth reel or reel 54*e*. Reel 54*e* includes one or more devil symbols, which negatively modify or decrease the bonus award associated with the target symbol 106. It should be appreciated that one or more positive modifier symbols and one or more negative modifier symbols may be included on one reel, a plurality of reels or all of the reels 54.

In one embodiment, the target symbol 106 is represented by a target that includes the phrase "target bonus" as shown in FIG. 3. It should be appreciated that the target symbol may include any suitable words, group of words or message. In one embodiment, the third reel or reel 54*c* is the only reel that includes the target symbol 106. Reel 54*c* may include one or more target symbols in a game. It should be appreciated that one or more target symbols may be included on one of the reels, a plurality of the reels or all of the reels. In this embodiment, the target symbol displays or reveals a bonus outcome such as a bonus award in the game when the target symbol is indicated on reel 54*c*. The bonus outcome or bonus award includes at least one value, credit, free spin, free game, modifier or any other suitable award. It should be appreciated that the bonus outcome or bonus award associated with the target symbol 106 may be predetermined, randomly determined, determined based on a wager made by the player in a game or determined according to any suitable determination method.

In one embodiment, the bonus game is triggered in a base game when at least one angel symbol 102 and at least one target symbol 106 are indicated on reels 54*a* and 54*c*, respectively. In another embodiment, the bonus game is triggered from the base game when at least one angel symbol 102, at least one target symbol 106 and at least one devil symbol 104 are indicated on reels 54*a*, 54*c* and 54*e*, respectively. It should be appreciated that any suitable combination including at least one angel symbol 102 and at least one target symbol 106 may be employed in a game to trigger the secondary or bonus game from the primary or base game.

When an angel symbol 102 and a target symbol 106 are indicated on reels 54*a* and 54*c*, the bonus game is triggered. A gaming device stops spinning the reels and blocks out or removes the symbols on the reels which are not an angel symbol 102, a target symbol 106 or a devil symbol 104. The gaming device then displays a message or instruction 105 which prompts the player to take some action in the bonus game to initiate the play of the bonus game. For example, in FIG. 3, the gaming device displays a message "touch the target" which prompts the player to physically touch the target symbol 106, which is displayed on a suitable touch screen display, to initiate the play of the bonus game.

In one embodiment, when the player touches or otherwise presses the target symbol 106 on the display device 16, 18, the gaming device causes the target symbol 106 to spin or rotate a few times and then indicate a bonus outcome such as a bonus award to the player. It should be appreciated that the bonus outcome or bonus award may be displayed to the player in any suitable method desired by the game implementer. It should also be appreciated that the bonus outcome or bonus award may be a number of credits, a number of free spins, a number of free games, a game element to be employed with a designated symbol combination indicated on the reels in the base game, a game element to be employed in a designated symbol combination indicated on the reels of the bonus game or any other suitable award or awards. In one embodiment, the gaming device causes the target symbol 106 to display a bonus award such as a value or number of credits.

After the bonus award is displayed to the player on target symbol 106, the gaming device causes the negative modifier symbol or devil symbol 104 to negatively modify the bonus award associated with the target symbol 106. Specifically, the devil symbol 104 generates negative modifiers such as negative values that reduce the bonus award associated with the target symbol 106. In one embodiment, each negative modifier symbol or devil symbol 104 indicated on reel 54E generates one negative modifier that reduces the bonus award associated with the target symbol 106. In another embodiment, each devil symbol 104 generates a plurality of negative modifiers which reduce the bonus award associated with the target symbol 106. It should be appreciated that each negative modifier symbol or devil symbol 104 may generate one or a plurality of negative modifiers that reduce the bonus award associated with the target symbol 106. In one embodiment, the negative modifiers generated by each devil symbol 104 indicated on reel 54E are represented by pitchforks which are thrown from the devil symbol 104 towards the target symbol 106. If the pitchfork hits the target symbol 106, the negative modifier associated with that pitchfork reduces the bonus award associated with the target symbol 106 by the value of the negative modifier. If the pitchfork misses the target symbol 106, the negative modifier associated with that pitchfork does not effect the bonus award associated with the target symbol 106. It should be appreciated that the negative modifier generated by the negative modifier symbol or devil symbol 104 may be represented by any suitable picture, character, image or any other suitable image or animated image desired by the game implementer. It should also be appreciated that the negative modifier generated by the devil symbol 104 may include at least one negative value, negative percentage, or any other suitable negative modifier or null modifier.

In one embodiment, the positive modifier symbol or angel symbol 102 generates positive modifiers which increase or enhance the bonus award associated with the target symbol 106. The positive modifiers may be positive values, positive multiplier, positive percentages or any other suitable positive modifier. In one embodiment, each positive modifier generated by the angel symbol 102 is represented by an arrow which is shot or thrown at the target symbol 106. Generally, the arrows thrown by the angels of a 102 do not miss the target symbol 106. It should be appreciated that the positive modifiers generated by the positive modifier symbol or angel symbol 102 may be any suitable picture, character, image or animated image or images.

In one embodiment, when one or more negative modifier symbols or devil symbols 104 are indicated on reel 54E, the negative modifier symbol or symbols modify the bonus award associated with the target symbol 106 before the angel symbols 102 modify the bonus award. This enables the game to end with positive values being added to the bonus award which increases the player's excitement and enjoyment level of the game. In another embodiment, when there are a plurality of devil symbols 104 and a plurality of angel symbols 102, the devil symbols and angel symbols alternately generate modifiers which effect the bonus award associated with the target symbol 106. It should be appreciated that any suitable order or sequence of negative modifiers and positive modifiers may be generated in a game to effect the bonus outcome or bonus award associated with the target symbol 106. The final bonus award displayed to the player after all of the negative modifiers and positive modifiers have been applied to that bonus award is the bonus award that is provided to the player for the bonus game. At this point, the bonus award is provided to the player and indicated in the total award display 108 and the game ends. The gaming device then resumes the play of the base or primary game of the gaming device.

Referring to FIGS. 4A to 4J, an example of the embodiment of FIG. 3 is illustrated where a bonus game is triggered when an angel symbol 102, a target symbol 106 and a devil symbol 104 are indicated on reels 54A, 54C and 54E, respectively.

Figure 4A:
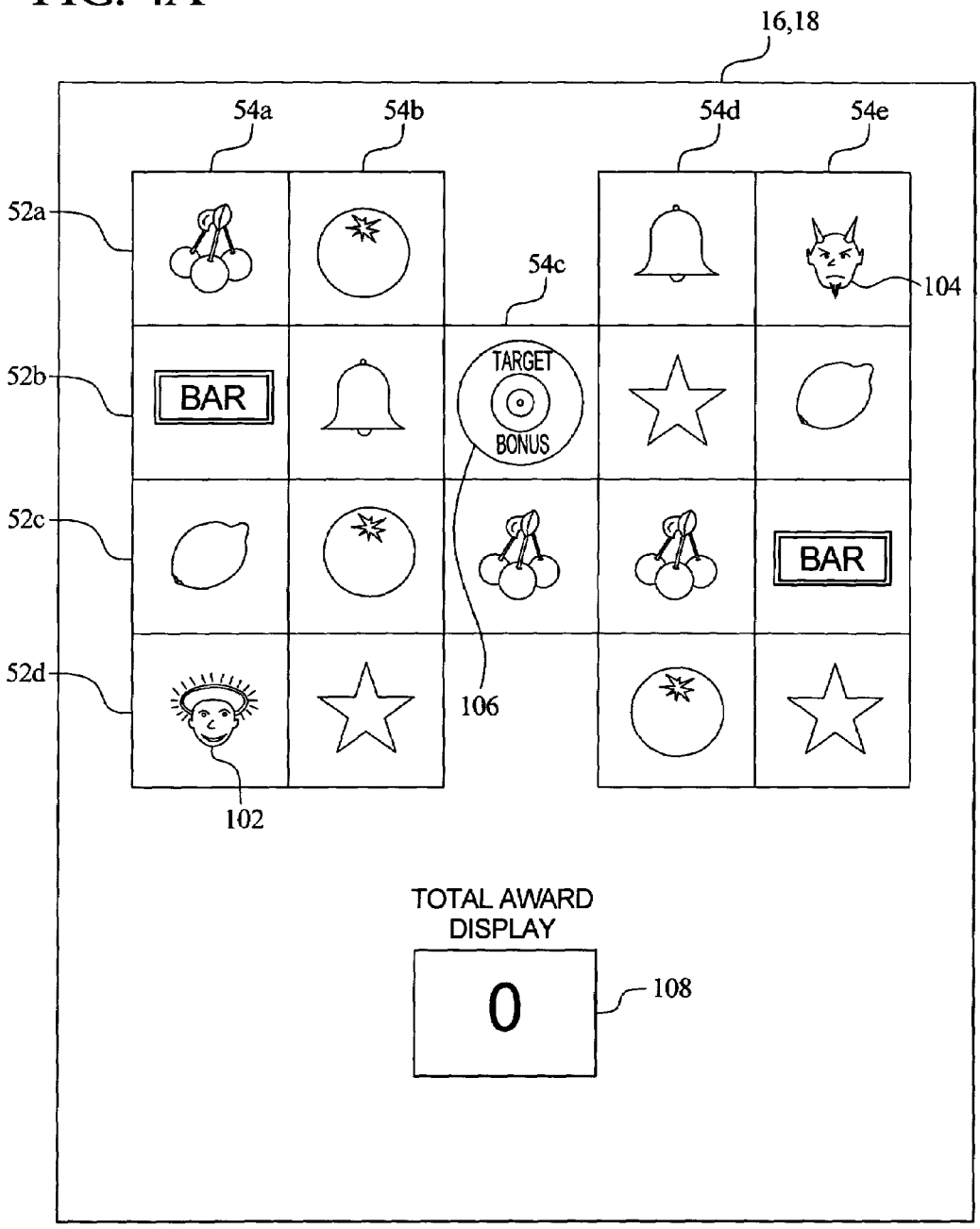
Figure 4B:
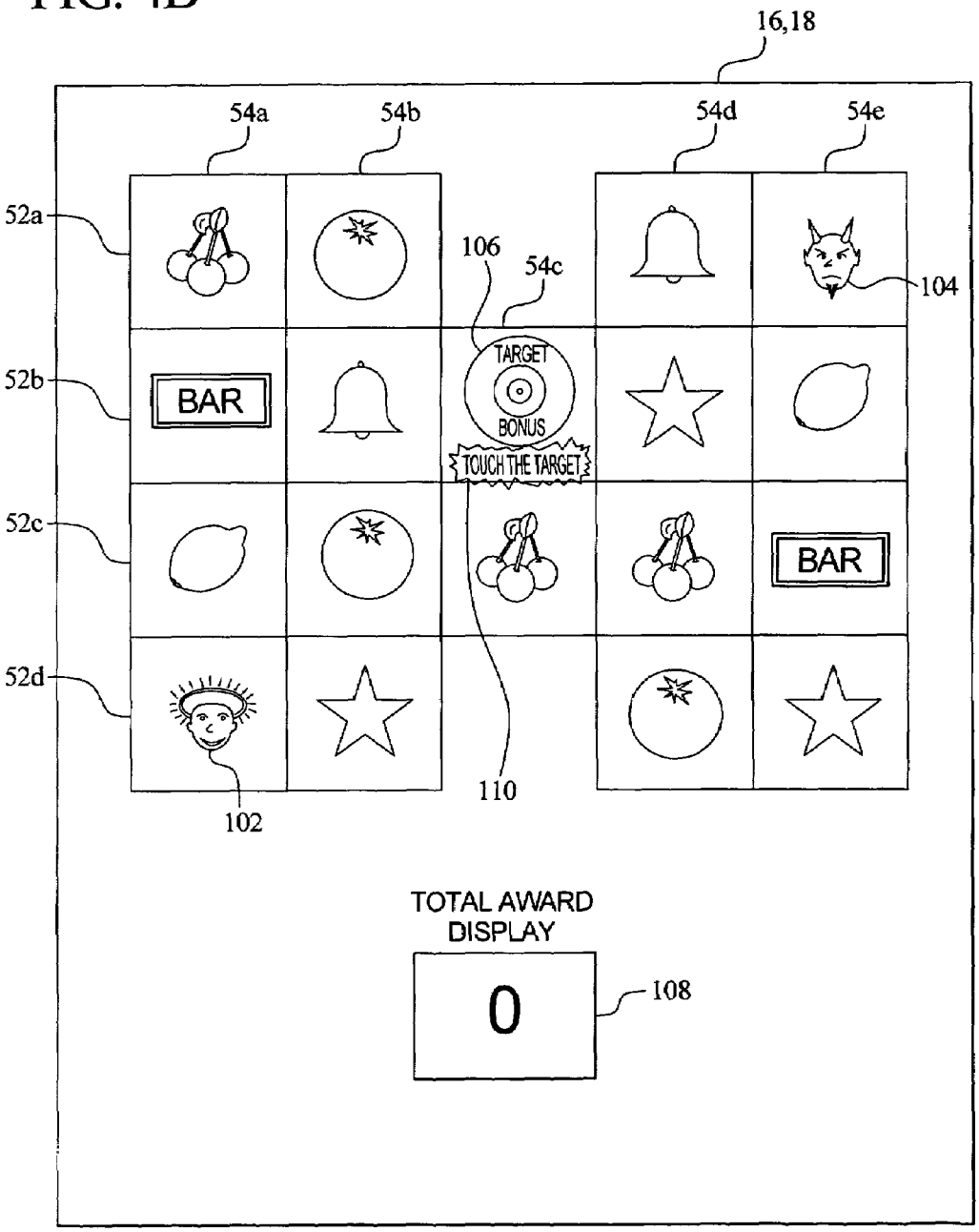

Referring to FIG. 4B, once the bonus game is initiated, the gaming device displays a message 110 which in this example is the phrase "touch the target." Therefore, the gaming device prompts the player to physically touch or press the target symbol 106 on the display device 16, 18 to initiate play of the bonus game.

Figure 4C:
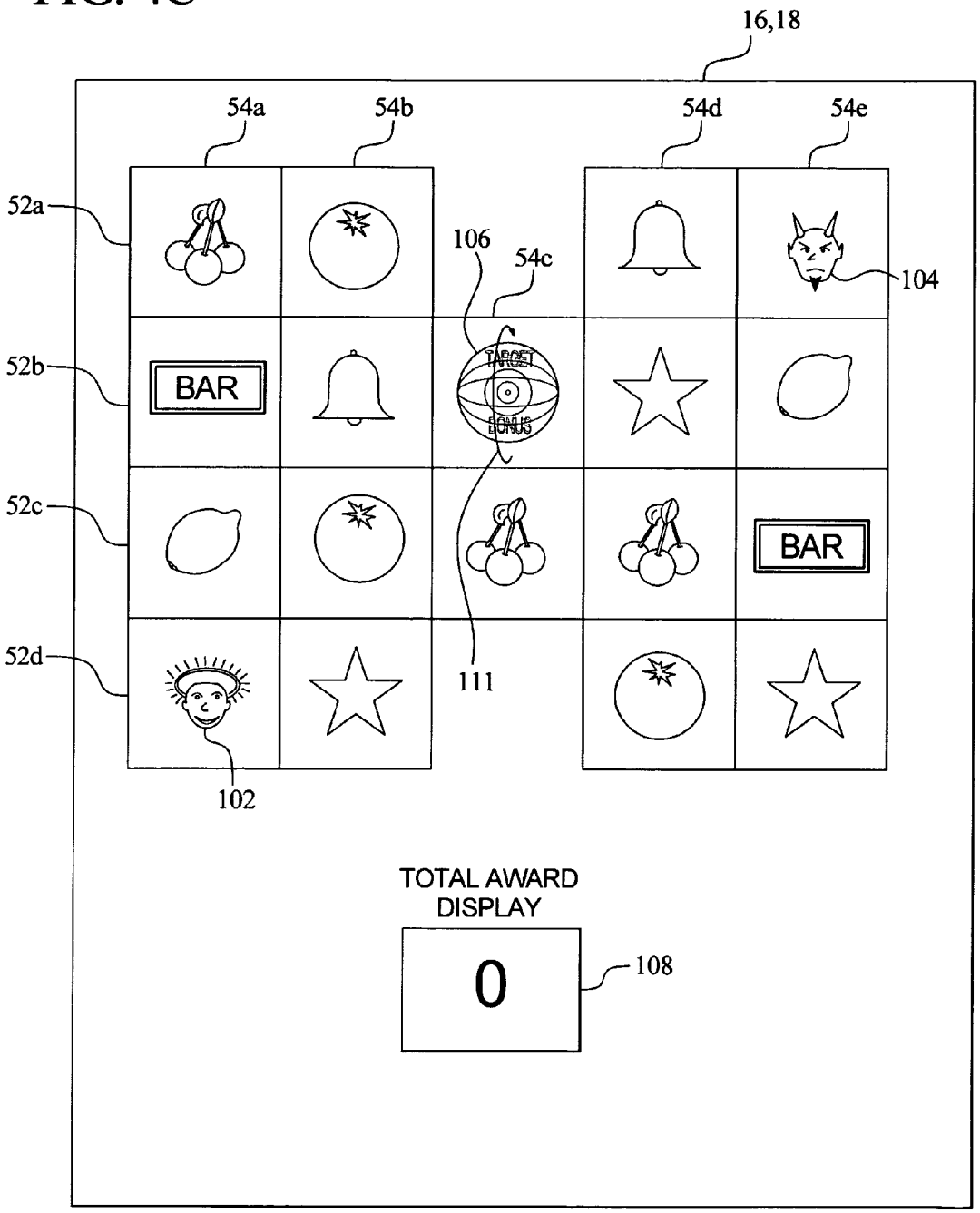
Figure 4D:
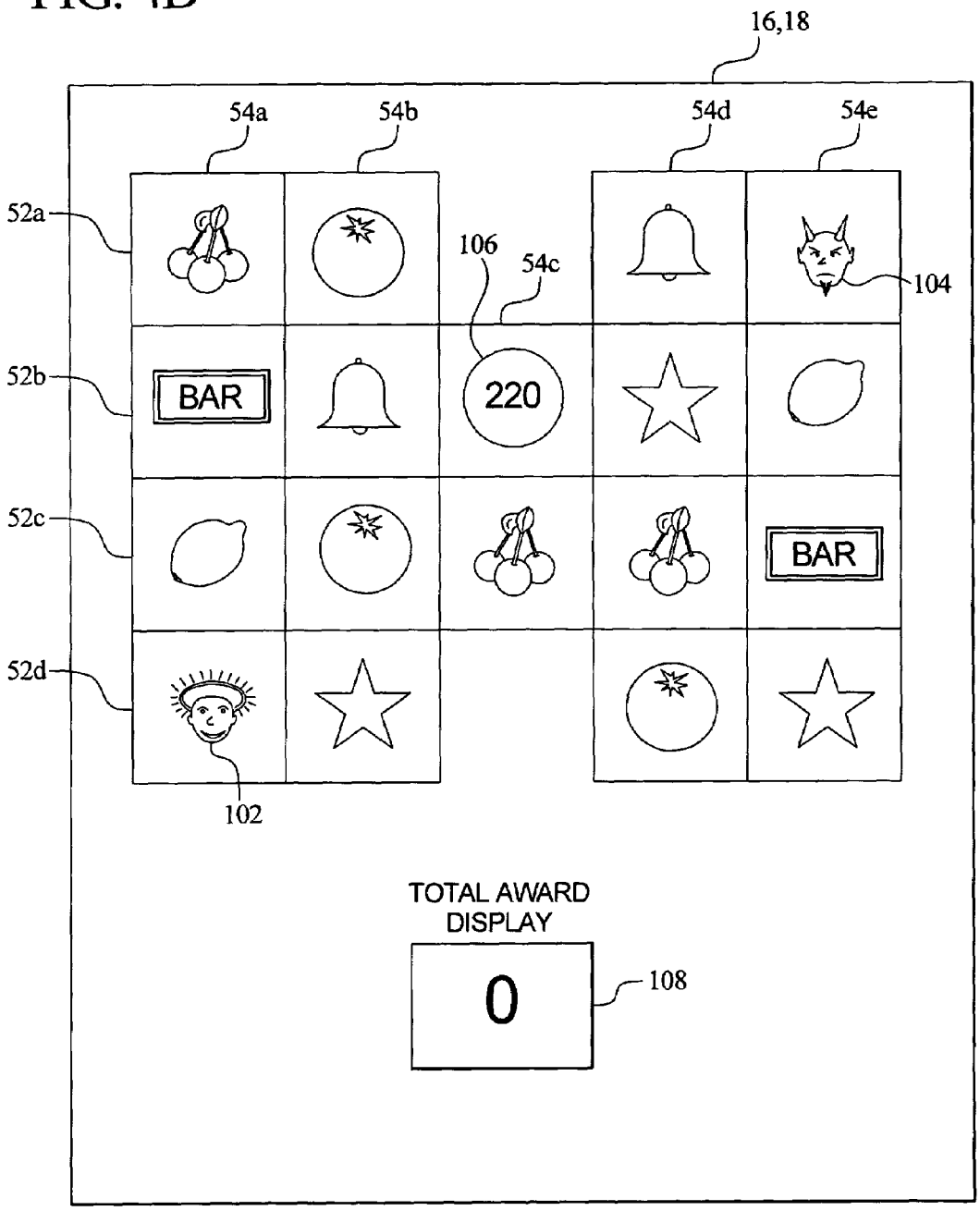

Referring to FIG. 4C, once the player touches or presses the target symbol 106, the target symbol begins to spin in the direction indicated by arrow 111. It should be appreciated that the target symbol may spin at any suitable direction or directions. Once the target symbol stops spinning, a bonus outcome such as a bonus award is displayed or indicated to the player. In this example, a bonus award of 220 is displayed to the player as shown in FIG. 4D.

Figure 4E:
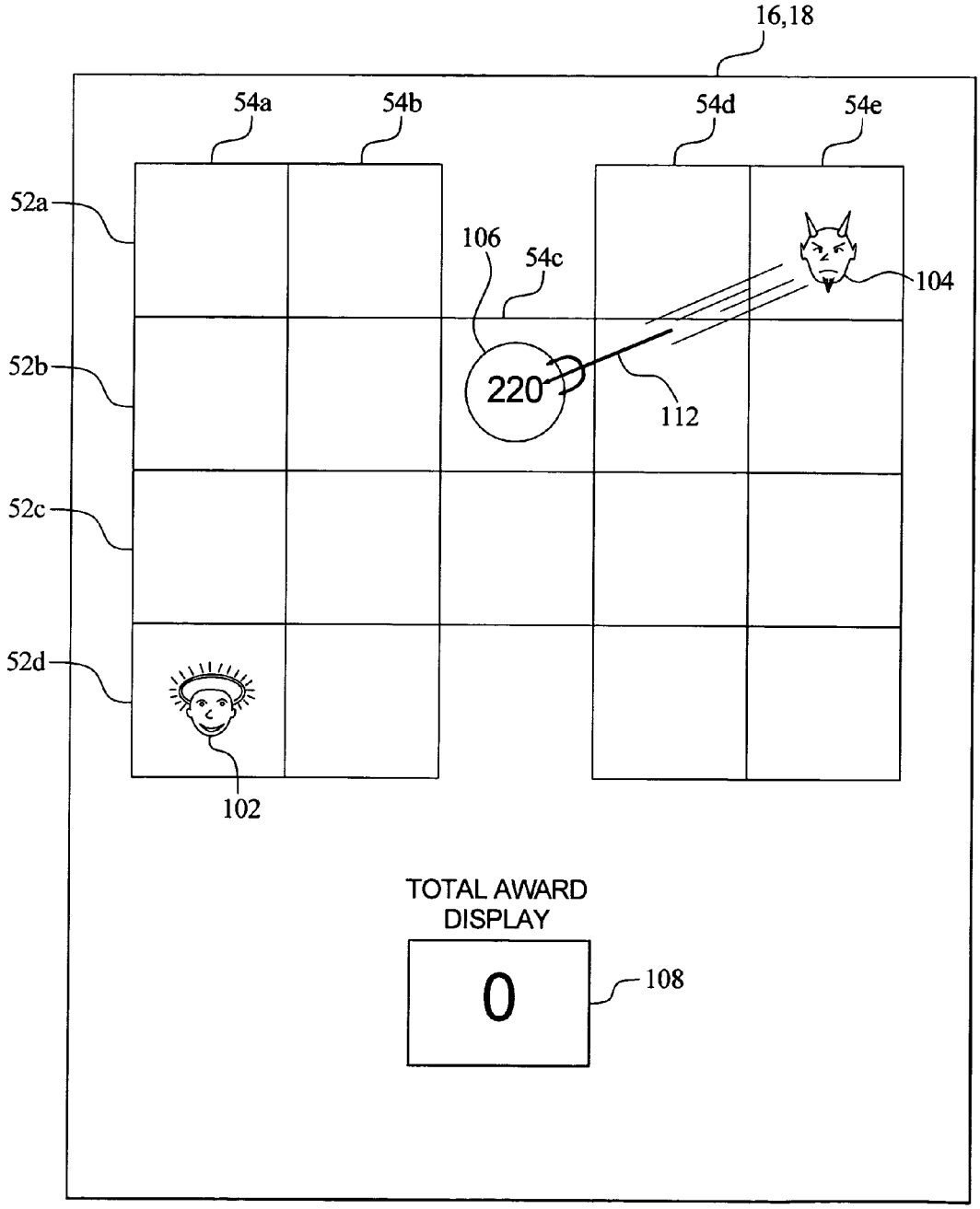

Referring to FIG. 4E, the gaming device blocks out or eliminates all of the symbols on the reels 54 which are not an angel symbol 102, a target symbol 106 or a devil symbol 104 as shown in FIG. 4E. It should be appreciated that the gaming device may alternatively shade or otherwise color these symbols to indicate that the symbols are not included in the game.

In one embodiment, the negative modifier symbol or devil symbol 104 attempts to negatively modify or reduce the bonus award associated with target symbol 106 by generating a negative modifier and applying that modifier to the bonus award. As shown in FIG. 4E, the negative modifier is represented by a pitchfork 112 which is thrown towards the target symbol 106. The negative modifier associated with the pitchfork 112 may be randomly determined, predetermined, determined based on a wager made by the player or determined according to any suitable determination method. The value or amount of the negative modifier is not shown to the player as the pitchfork is thrown towards the target symbol 106. The player determines the value of the negative modifier by the amount that the bonus award associated with the target symbol 106 is reduced. In another embodiment, the value of the negative modifier is displayed to the player on the pitchfork 112 or is otherwise associated with the pitchfork as the pitchfork travels towards the target symbol 106.

Figure 4F:
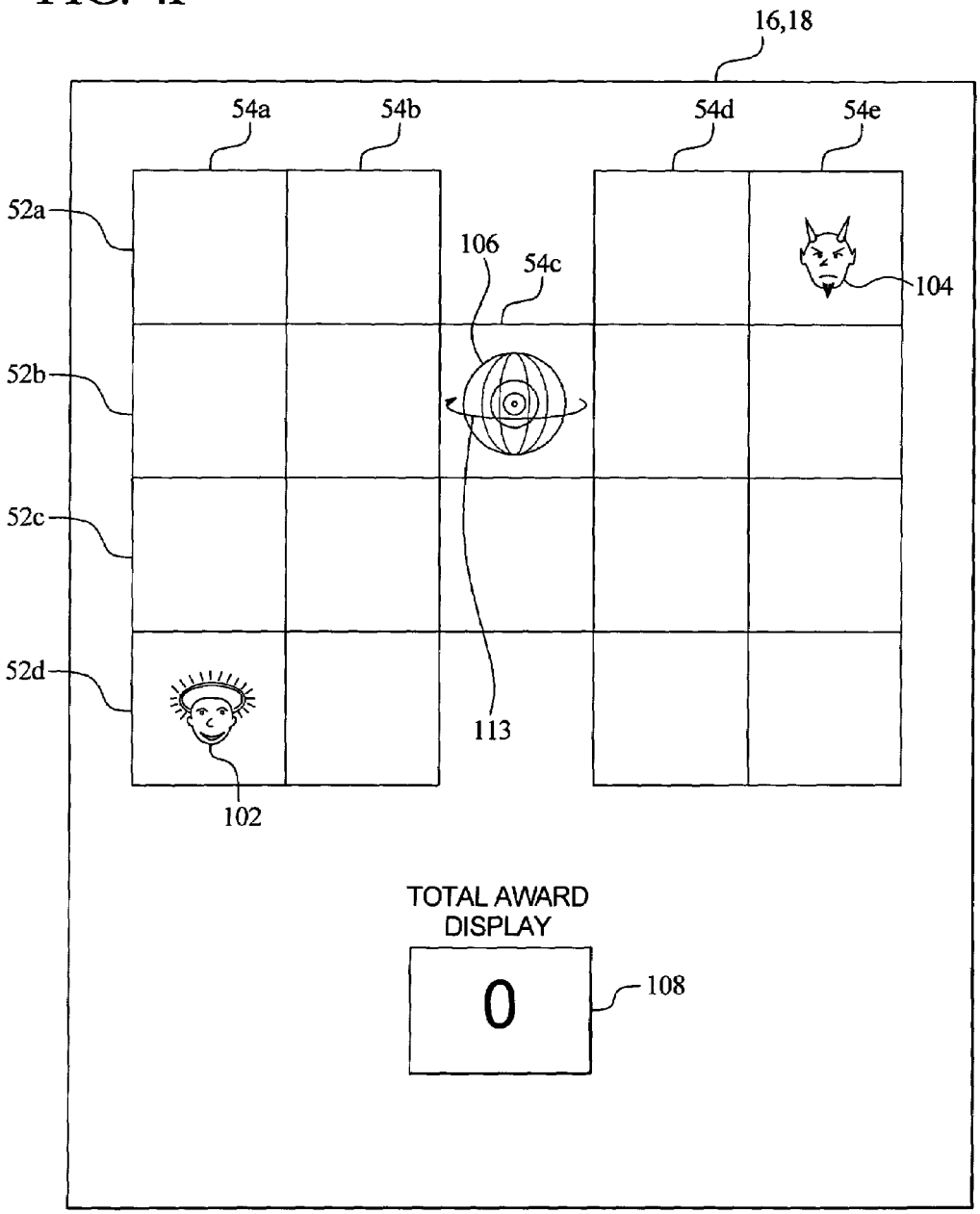
Figure 4G:
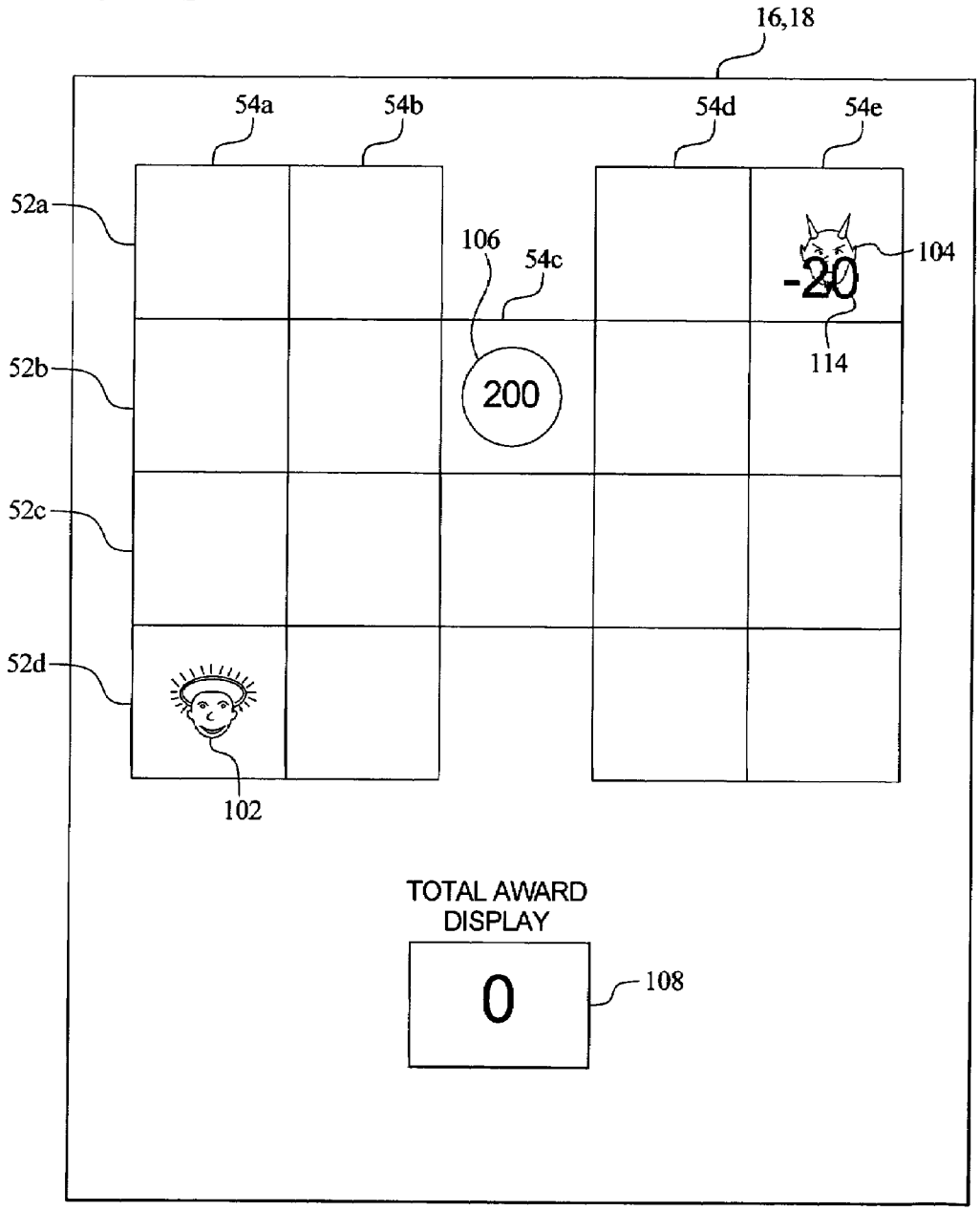

Referring to FIG. 4F, if the pitchfork hits the target symbol 106, the target symbol begins to spin in the direction indicated by arrow 113. After the target symbols stop spinning, the reduced bonus award is indicated or displayed by the target symbol 106. In this example, the negative modifier associated with the pitchfork that hit the target symbol in FIG. 4E reduced the bonus award by a value of twenty. Therefore, the new bonus award is two hundred as shown on the target symbol in FIG. 4G. Additionally, the value of the negative modifier is displayed with the negative modifier symbol or devil symbol 104 that generated the negative modifier. As shown in FIG. 4G, the negative value is superimposed on the devil symbol 104. It should be appreciated that the value may be superimposed, indicated adjacent to the devil symbol or associated with the devil symbol in any suitable manner.

Figure 4H:
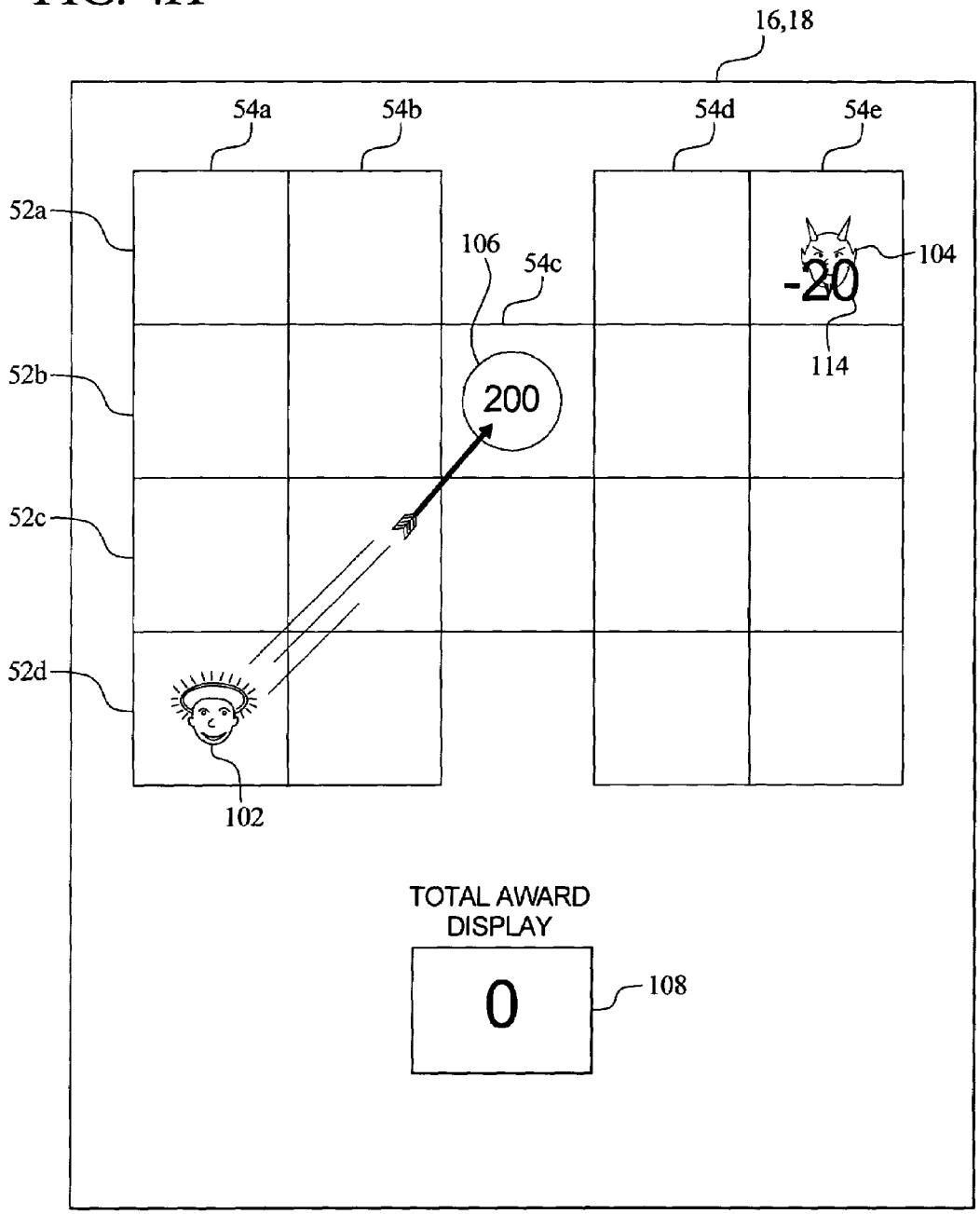

Referring to FIG. 4H, the devil symbol 104 in this example only generates one negative modifier. Therefore, the positive modifier symbol or angel symbol 102 now generates one or more positive modifiers to increase the bonus award associated with the target symbol 106. In this example, the positive modifier symbol or angel symbol 102 generates a positive modifier which is associated with the arrow 116. The arrow 116 is thrown at or projected towards the target symbol 106.

Figure 4I:
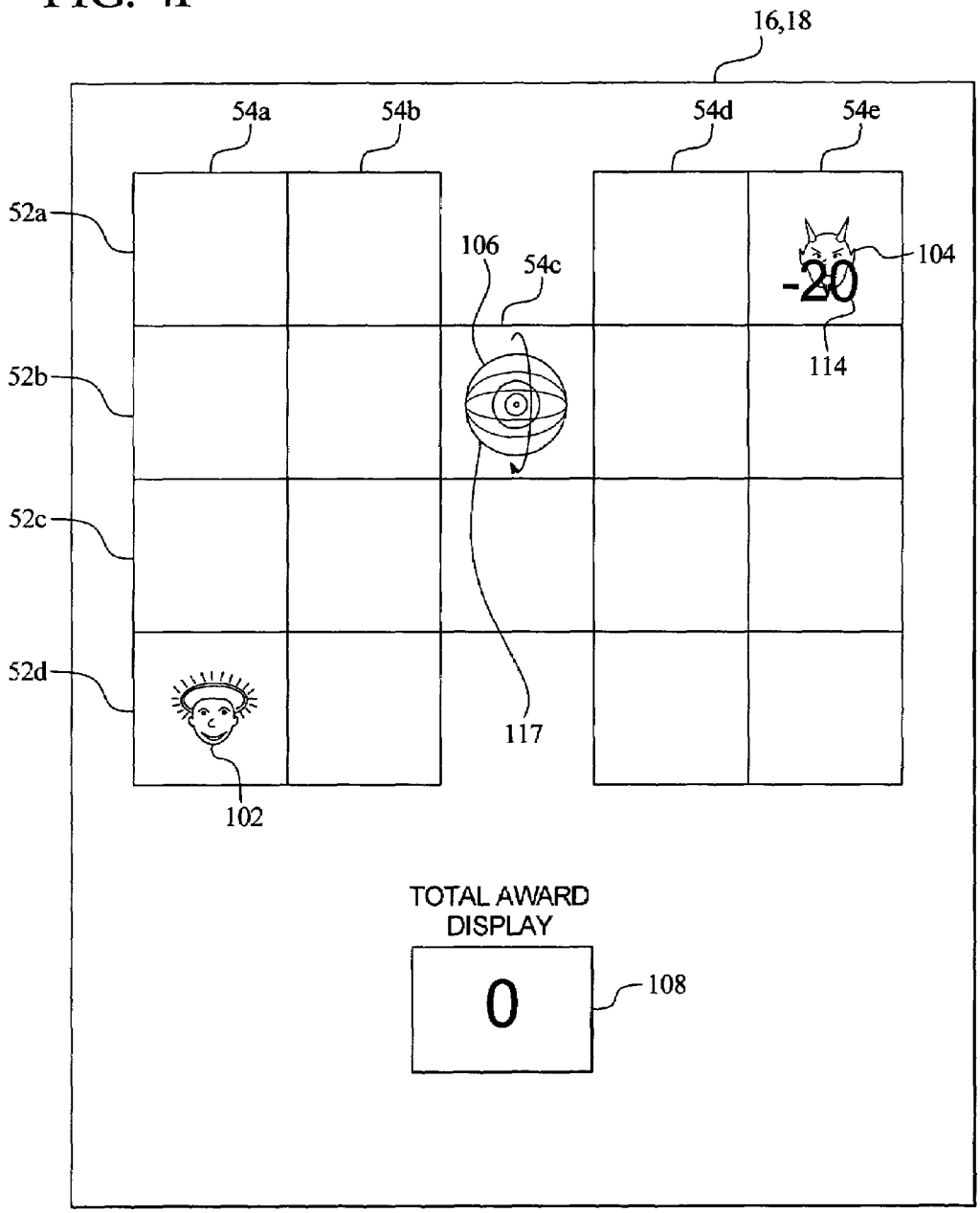
Figure 4J:
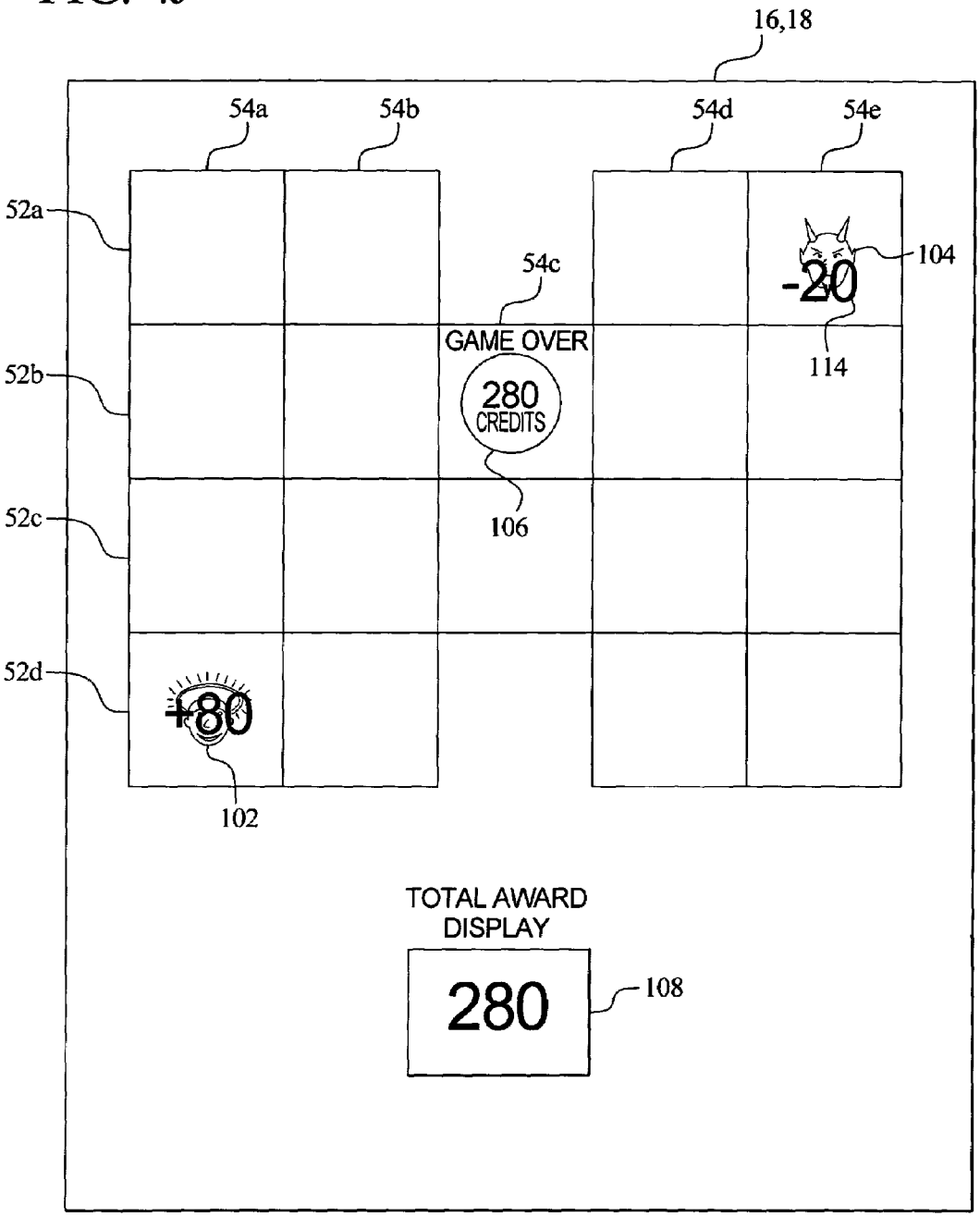

Referring to FIG. 4I, the arrow 116 hits the target symbol 106 and causes the target symbol to spin in the direction indicated by the arrow 117. Once the target symbol 106 stops spinning, the modified or increased bonus award is displayed to the player. In this example, the new bonus award is an award of two hundred eighty. Therefore, the positive modifier generated by the angel symbol 102 was a positive value of eighty. The gaming device displays or superimposes the positive value associated with the positive modifier generated by the angel symbol 102 on or adjacent to the angel symbol on the reels as indicated in FIG. 4J. Because only one positive modifier is generated by the angel symbol 102 in this game, the game ends and the player receives the bonus award of two hundred eighty credits associated with the target symbol 106 as shown in FIG. 4J. The bonus award of two hundred eighty is transferred and indicated by the total award display 108. The game ends and the gaming device returns the player to the base or primary game.

Figure 5:
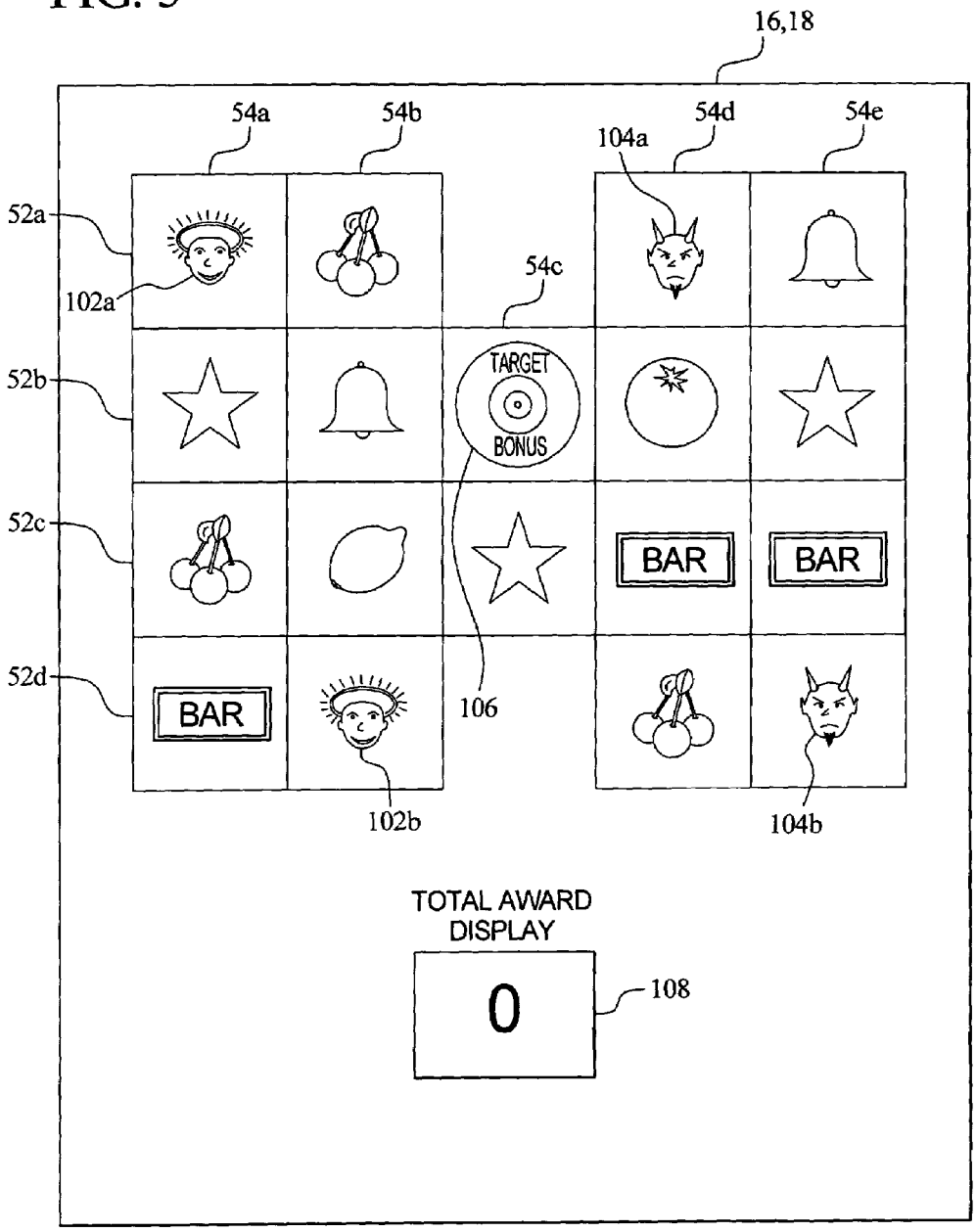
FIG. 5 is an enlarged front elevation view of one of the display device of FIGS. 1A and 1B illustrating two positive modifier symbols and two negative modifier symbols occurring on the reels.

Referring to FIG. 5, in one embodiment, the reels 54 include a plurality of positive modifier symbols such as the angel symbols 102*a* and 102*b* and a plurality of negative modifier symbols such as the devil symbols 104*a* and 104*b*. In this embodiment, when an award symbol such as the target symbol 106, and the plurality of positive and negative modifier symbols occur on the reels, the gaming device first causes each of the positive modifier symbols 102 to generate at least one positive modifier and apply the positive modifiers to the bonus award associated with the award symbol. The gaming device then causes each of the negative modifier symbols 104 to generate at least one negative modifier and applies the negative modifiers to the bonus award.

In another embodiment, the gaming device first causes each of the negative modifier symbols 104 to generate at least one negative modifier and applies the negative modifiers to the bonus award. The gaming device then causes each of the positive modifier symbols 102 to generate at least one positive modifier and applies the positive modifiers to the bonus award. In a further embodiment, the gaming device causes the positive and negative modifier symbols to alternately generate positive and negative modifiers and alternately applies the positive and negative modifiers to the bonus award. It should be appreciated that the positive and negative modifiers may be generated and applied to the bonus award associated with the award symbol simultaneously, sequentially or in any suitable order or sequence.

In one embodiment, the reels include a plurality of award symbols and at least one positive modifier symbol and at least one negative modifier symbol. In this embodiment, when two or more of the award symbols occur on the reels, the gaming device provides at least one bonus award associated with each of the award symbols to the player. In one embodiment, the gaming device first causes any positive modifier symbols that occur on the reels to generate at least one positive modifier and applies the positive modifier or modifiers to the bonus award. The gaming device then causes any negative modifier symbols occurring on the reels to generate at least one negative modifier and applies the negative modifier or modifiers to the bonus award. In another embodiment, all of the negative modifiers symbols generate and apply negative modifiers to the bonus award before the positive modifier symbols generate and apply any positive modifiers to the bonus award. In a further embodiment, all of the positive and negative modifier symbols generate and apply positive and negative modifiers to each of the bonus awards associated with each of the award symbols separately in a designated order or sequence.

In a further embodiment, a designated number of positive modifiers are associated with each of the positive modifier symbols occurring on the reels and a designated number of negative modifiers are associated with each of the negative modifier symbols occurring on the reels. In one aspect of this embodiment, the designated number of positive and negative modifiers associated with each of the positive and negative modifier symbols is randomly determined. In this aspect, the values or amounts of each of the positive and negative modifiers may be pre-determined, randomly determined or determined according to any suitable determination method. In another aspect of this embodiment, the designated number of positive and negative modifiers associated with each of the positive and negative modifier symbols is pre-determined, as described above, in this aspect, the values or amounts of each of the positive and negative modifiers may be pre-determined, randomly determined or determined according to any suitable determination method. It should be appreciated that any suitable number of positive and negative modifiers may be generated and applied to the bonus award associated with one or more award symbols.

In one embodiment, the positive and negative values associated with the positive modifier symbol 102 and the negative modifier symbol 104, respectively, are randomly determined and selected from a group or groups of positive modifiers and negative modifiers. In another embodiment, the positive and negative values associated with the positive modifiers and negative modifiers are predetermined. It should be appreciated that the values or amounts of the positive modifiers and the negative modifiers may be randomly determined, predetermined, determined based on a wager made by the player or determined according to any suitable determination method.

In another embodiment, a probability of being selected and generated by the positive modifier symbol or the negative modifier symbol is associated with each of the positive modifiers and negative modifiers. Therefore, some of the positive and/or negative modifiers are more likely to be applied to the bonus award in a game than other positive and negative modifiers. In one embodiment, the positive modifiers include at least one relatively large modifier and a plurality of relatively small modifiers. Similarly, the negative modifiers include one relatively large negative modifier and a plurality of relatively small negative modifiers. In this embodiment, the probabilities associated with the relatively large positive modifier and the relatively large negative modifier are less than the probabilities associated with the plurality of relatively small positive modifiers and relatively small negative modifiers. It should be appreciated that any suitable probability may be associated with the positive and negative modifiers in a game.

It should be appreciated that the present invention may be employed in a primary game, a secondary or bonus game, or any other suitable type of game.

It should be appreciated that when the independent reels as disclosed in U.S. Pat. No. 6,413,162 are employed in the present invention, the reels enable each position to have positive or negative incrementing or decrementing symbols as allowed on each of the reels to create more excitement. Additionally, multiple target symbols can occur, which each can provide multiple outcome events which can be positive or negative.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming device operable under control of at least one processor, said gaming device comprising:

a game operable upon a wager by a player;

a plurality of reels including a plurality of symbols in said game, said symbols including at least one award symbol, at least one positive modifier symbol and at least one negative modifier symbol; and said at least one processor programmed for a play of the game to:

(a) randomly determine a number of the positive modifier symbols to display on the reels;

(b) randomly determine a number of the negative modifier symbols to display on the reels;

(c) for each of the number of positive modifier symbols to be displayed on the reels, randomly determine a value to associate with the positive modifier symbol;

(d) for each of the number of negative modifier symbols to be displayed on the reels, randomly determine a value to associate with the negative modifier symbol;

(e) cause a display of a plurality of the symbols on the reels based on said determinations, wherein for each of any displayed positive modifier symbols and negative modifier symbols, the value associated with the symbol is masked until a triggering event occurs and an award is modified;

(f) upon an occurrence of the triggering event based on at least said award symbol and said positive modifier symbol being displayed simultaneously on the reels, enable a player to select an input associated with the award symbol and display the award associated with said award symbol after the player selects the input;

(g) modify the award by a designated number of positive modifiers associated with any of said positive modifier symbols displayed on said reels, and cause a display of each modification to the award from said positive modifiers;

(h) modify the award by a designated number of negative modifiers associated with any of said negative modifier symbols displayed on said reels, and cause a display of each modification to the award from said negative modifiers; and (i) provide the modified award to the player for the play of the game.

2. The gaming device of claim 1, wherein the positive modifier includes at least one of the following: a positive value, a positive multiplier and a positive percentage of the award.

3. The gaming device of claim 1, wherein the negative modifier includes at least one of the following: a negative value and a negative percentage of the award.

4. The gaming device of claim 1, wherein a probability of being selected is associated with each of the positive and negative modifiers.

5. The gaming device of claim 1, wherein at least one relatively large positive modifier and a plurality of relatively small positive modifiers are associated with the positive modifier symbol.

6. The gaming device of claim 5, wherein the probability associated with the relatively large positive modifier is less than the at least one of the probabilities associated with the plurality of relatively small positive modifiers.

7. The gaming device of claim 1, wherein at least one relatively large negative modifier and a plurality of relatively small negative modifiers are associated with the negative modifier symbol.

8. The gaming device of claim 7, wherein the probability associated with the relatively large negative modifier is less than the plurality of probabilities associated with the plurality of relatively small negative modifiers.

9. The gaming device of claim 1, wherein the plurality of reels include a plurality of independent reels.

10. The gaming device of claim 1, wherein the triggering event occurs on a payline associated with the reels.

11. The gaming device of claim 1, wherein the triggering event occurs on a plurality of paylines associated with the reels.

12. The gaming device of claim 1, wherein the award associated with the award symbol is randomly determined.

13. The gaming device of claim 1, wherein the award associated with the award symbol is predetermined.

14. The gaming device of claim 1, wherein the average value of the modifiers applied to the award is greater than zero.

15. The gaming device of claim 1, wherein the designated number of positive modifiers and the designated number of negative modifiers for each symbol are randomly determined.

16. The gaming device of claim 1, wherein the triggering event occurs when at least one award symbol, at least one positive modifier symbol and at least one negative modifier symbol occur on the reels.

17. The gaming device of claim 1, wherein each positive modifier increases the award, and each negative modifier decreases the award.

18. The gaming device of claim 1, wherein the number of randomly determined positive modifier symbols is selected from the group consisting of: (a) zero, (b) one, and (c) more than one.

19. A gaming device comprising:

a game operable upon a wager by a player;

a plurality of reels in the game including a plurality of symbols, said symbols including at least one positive modifier symbol and at least one negative modifier symbol;

an award adapted to be provided to a player, the award associated with an award symbol;

at least one positive modifier value and at least one negative modifier value associated with each of said positive and negative modifier symbols occurring on the reels, wherein the average value of the positive and negative modifiers is greater than zero; and a processor programmed for each play of the game to:

(a) randomly determine a number of the positive modifier symbols to display on the reels;

(b) randomly determine a number of the negative modifier symbols to display on the reels;

(c) for each of the number of positive modifier symbols to be displayed on the reels, randomly determine a value to associate with the positive modifier symbol;

(d) for each of the number of negative modifier symbols to be displayed on the reels, randomly determine a value to associate with the negative modifier symbol;

(e) cause a display of a plurality of the symbols on the reels based on said determinations, wherein the positive modifier symbol and the negative modifier symbol are able to be simultaneously displayed and activated, wherein for each of any displayed positive modifier symbols and negative modifier symbols, the value associated with the symbol is masked until a triggering event occurs and the award is modified;

(f) upon an occurrence of the triggering event, enable a player to select an input associated with the award symbol and cause a display of the award after the player selects the input;

(g) modify the displayed award by any positive modifier values associated with any of the displayed positive modifier symbols, and cause a display of each modification to the displayed award from said positive modifier values;

(h) modify the award by any negative modifier values associated with any of the displayed negative modifier symbols, and cause a display of each modification to the displayed award from said negative modifier values; and (i) provide the modified award to the player for the play of the game.

20. The gaming device of claim 19, wherein the average value of the positive and negative modifiers in a plurality of the spins of the reels is approximately zero.

21. The gaming device of claim 19, wherein each positive modifier value increases the award, and each negative modifier value decreases the award.

22. The gaming device of claim 19, wherein the number of randomly determined positive modifier symbols is selected from the group consisting of: (a) zero, (b) one and (c) more than one.

23. A method of operating a gaming device having a game operable upon a wager, the method comprising:

(a) randomly determining a number of positive modifier symbols to display on a plurality of reels;

(b) randomly determining a number of negative modifier symbols to display on the plurality of reels;

(c) for each of the number of positive modifier symbols to be displayed on the plurality of reels, randomly determining a value to associate with the positive modifier symbol;

(d) for each of the number of negative modifier symbols to be displayed on the plurality of reels, randomly determining a value to associate with the negative modifier symbol;

(e) activating and displaying the plurality of reels based on said determinations, the plurality of reels including a plurality of symbols, said symbols including at least one award symbol, wherein for each of any displayed positive modifier symbols and negative modifier symbols, the value associated with the symbol is masked until a bonus game is initiated and a bonus award is modified;

(f) initiating the bonus game including the bonus award when at least said award symbol and said positive modifier symbol are simultaneously displayed on the reels;

(g) enabling a player to select an input associated with the award symbol and displaying the bonus award after the player selects the input;

(h) modifying the displayed bonus award with a designated number of negative modifiers associated with any of said negative modifier symbols displayed on the reels;

(i) displaying each modification to the displayed bonus award from said negative modifiers;

(j) modifying the bonus award with a designated number of positive modifiers associated with any of said positive modifier symbols displayed on the reels;

(k) displaying each modification to the bonus award from said positive modifiers; and (l) providing the modified bonus award to a player.

24. The method of claim 23, wherein modifying the bonus award includes modifying the bonus award with the designated number of negative modifiers associated with any of said negative modifier symbols displayed on the reels before modifying the bonus award with the designated number of positive modifiers associated with any of said positive modifier symbols displayed on the reels.

25. The method of claim 23, wherein modifying the bonus award includes modifying the bonus award with the designated number of negative modifiers associated with any of said negative modifier symbols displayed on the reels after modifying the bonus award with the designated number of positive modifiers associated with any of said positive modifier symbols displayed on the reels.

26. The method of claim 23, which includes associating a probability of being selected with each of the negative and positive modifiers.

27. The method of claim 23, wherein the average value of the positive and negative modifiers is approximately zero.

28. The method of claim 23, wherein the average value of the positive and negative modifiers is greater than zero.

29. The method of claim 23, wherein initiating the bonus game includes initiating the bonus game when at least one award symbol, at least one positive modifier symbol and at least one negative modifier symbol occur on the reels.

30. The method of claim 23, which is provided to the player through a data network.

31. The method of claim 30, wherein the data network is an internet.

32. The method of claim 23, which includes a different number of positive and negative symbols.

33. The method of claim 23, which includes a plurality of award symbols.

34. The method of claim 23, wherein each positive modifier increases the award, and each negative modifier decreases the award.

35. The method of claim 23, wherein the number of randomly determined positive modifier symbols is selected from the group consisting of: (a) zero, (b) one and (c) more than one.

* * * * *